US006234295B1

(12) United States Patent
Ogawa

(10) Patent No.: US 6,234,295 B1
(45) Date of Patent: May 22, 2001

(54) PASSENGER CONVEYOR SYSTEM

(75) Inventor: Yutaka Ogawa, Ibaraki (JP)

(73) Assignees: Nippon Fillestar Co., Osaka; Hitachi, Ltd.; Hitachi Building Systems Co., both of Tokyo, all of (JP)

( * ) Notice: Subject to any disclaimer, the term of this patent is extended or adjusted under 35 U.S.C. 154(b) by 0 days.

(21) Appl. No.: 09/445,891

(22) PCT Filed: Jun. 17, 1998

(86) PCT No.: PCT/JP98/02673

§ 371 Date: Dec. 15, 1999

§ 102(e) Date: Dec. 15, 1999

(87) PCT Pub. No.: WO98/57880

PCT Pub. Date: Dec. 23, 1998

(30) Foreign Application Priority Data

Jun. 17, 1997 (JP) ..... 9-177637
Dec. 3, 1997 (JP) ..... 9-333227

(51) Int. Cl.[7] ..... B65B 23/12
(52) U.S. Cl. ..... 198/333

(58) Field of Search ..... 198/321, 322, 198/326, 327, 328, 330, 332, 333

(56) References Cited

U.S. PATENT DOCUMENTS 5,330,042 * 7/1994 Ogimura et al. ..... 198/333
5,353,907 * 10/1994 Ogimura et al. ..... 198/333
5,435,428 * 7/1995 Adachi et al. ..... 198/324

* cited by examiner

*Primary Examiner*—Christopher P. Ellis
*Assistant Examiner*—Kenneth W Bower
(74) *Attorney, Agent, or Firm*—Antonelli, Tery, Stout & Kraus, LLP

(57) ABSTRACT

A passenger transportation conveyor apparatus features a minimized space for installation thereof by reducing the height of the machine room for accommodating the support frame structure, a smooth transition of step boards between the forward and the return routes or vice versa enabled by a unique arrangement of the plurality of step boards connected endlessly and transfer mechanisms for allowing a circular travel with an upper surface of each step board constantly facing upward.

17 Claims, 25 Drawing Sheets

PASSENGER CONVEYOR SYSTEM

BACKGROUND OF THE INVENTION

The present invention relates to a passenger transportation conveyor apparatus, such as an escalator, auto-lane or the like, which can be installed easily, for example, on stairways, such as in a railroad station, in public facilities, along a slope or on a flat plane.

A passenger transportation conveyor apparatus which is designed to reduce the space required for installation of, for example, an escalator, and in particular, the height of its support frame, has been disclosed, for example, in Japanese Patent Publication No. 48-19996 and Japanese Patent Laid-open No. 6-32577.

The aforementioned passenger transportation conveyor apparatus is comprised of substantially a large-sized guide wheel installed in a machine room on both ends of a transportation path in the longitudinal direction of the conveyor support frame, wherein a string of step-boards wound around the periphery of the large sized guide wheel are reversed in their direction of travel with the surfaces of their step boards being reversed or facing downward on the return run. Therefore, while the height of the machine room or the support frame nevertheless has been reduced, the space required for installation of the passenger transportation conveyor itself prevented from being reduced.

SUMMARY OF THE INVENTION

An object of the invention is to provide a novel passenger transportation conveyor apparatus that can accomplish reduction of the space required for installation thereof by reducing the height of the machine room which accommodates its support frame.

Another object of the invention is to provide a passenger transportation conveyor that allows a plurality of step boards thereof to be transported smoothly along a forward direction and a return direction between floors.

In order to accomplish the aforementioned objects of the invention, a passenger transportation conveyor is provided which has a plurality of step boards connected endlessly so as to be circulated along the length its support frame, wherein said plurality of step boards are allowed to move circularly along both the forward and return directions with the surfaces of the step boards facing upward.

By provision of the aforementioned arrangement, each step board moving along the forward direction (or return direction) enters a path of the return direction (or forward direction) with the upper surface of step board facing upward. Therefore, the height of the support frame structure need only be enough to allow each step board, with its upper surface facing upward, to be transported between the forward and the return direction routes, because there is no need to provide for a large diameter guide wheel to allow each step board to be reversed by 180 degrees. As a result, the height of the support frame structure, at a portion thereof where the direction of movement of each step board is reversed, can be substantially reduced, thereby minimizing the space of installation thereof.

Further, a transfer mechanism is provided for transferring each step board between the two directions of travel while maintaining the upper surface thereof facing upward, thereby ensuring a smooth transfer of the step boards between the forward route and the return route.

BRIEF DESCRIPTION OF THE DRAWINGS

FIG. 2A depicts a state of a horizontal transfer roller riding over an upper transfer guide rail, and FIG. 2B depicts a state of the horizontal transfer roller after riding over the upper transfer guide rail.

DETAILED DESCRIPTION OF THE PREFERRED EMBODIMENT

Figure 1:
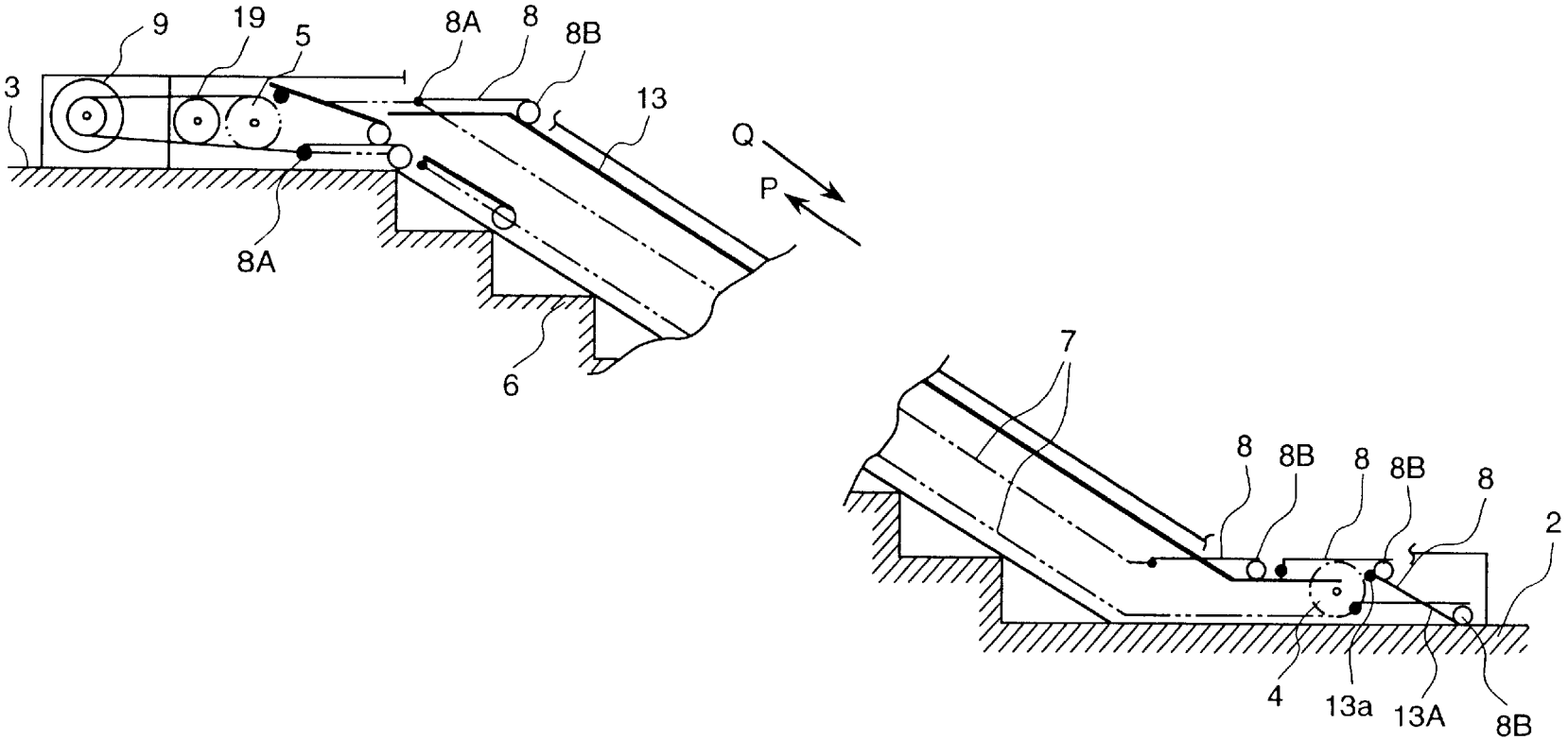
FIG. 1 is a diagram illustrating a side view of an escalator apparatus according to a first embodiment of the invention.

A passenger transportation conveyor according to a first embodiment of the invention will be described with reference to FIGS. 1–4. An escalator apparatus 1 has a support frame structure 41 including a pair of side frame structures 41A and a bottom frame 41B for connecting the pair of side frames 41A. This support frame structure 41 is installed on a staircase 6 provided from a lower floor 2 to an upper floor 3.

In an upper end portion of both of the side frames 41A of this support frame 41 in a longitudinal direction thereof, a pair of upper sprockets 5 are mounted rotatably around an axis, and in a lower end portion thereof , a pair of lower sprockets 4 are mounted rotatably.

Side frame 41A has approximately a level surface on the upper and the lower end portions thereof and a tilt structure in its intermediate section with a tilt angle corresponding to the angle of the staircase 6.

A pair of drive chains are wound around the aforementioned upper sprockets 5 and the lower sprockets 4 symmetrically. Each drive chain 7 is arranged to travel within or on a bottom frame 41B in its return route.

Figure 28:
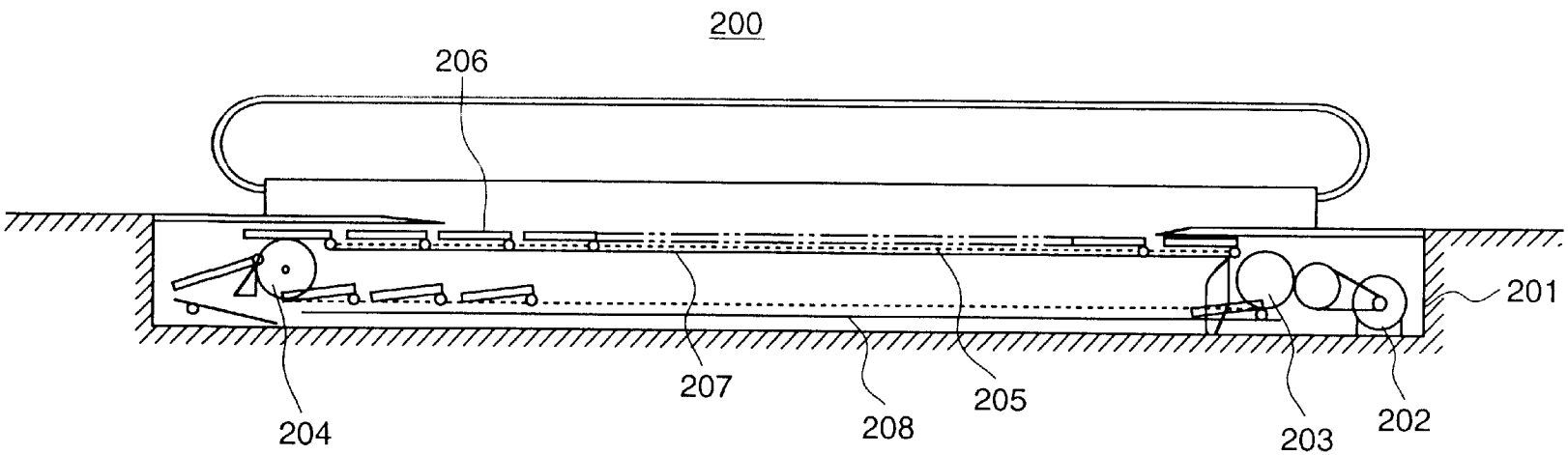
FIG. 28 is a side view of an electric auto-lane according to a sixth embodiment of the invention.

A base end portion of each step board 8 is connected rotatably by way of a pin 8A between the pair of symmetrical drive chains 7, and a horizontal transfer roller 8B is mounted rotatably via axis 8S at the opposite end portion of the step board B, as seen in FIG. 28.

This horizontal transfer roller 8B is guided by a guide rail 13 installed in both side frames 41A. This horizontal transfer roller 8B and guide rail 13 constitute a guide means G.

Guide rail 13 is provided in an intermediate tilt section along a forward direction path of step board 8, and is positioned to be offset from drive chain 7 in a direction toward the bottom frame 41B in a range from the lower portion of side frame 41A to the intermediate tilt section in the longitudinal direction of the side frame 41A, and is positioned once again near the drive chain 7 in the upper end portion in the longitudinal direction of side frame 41A. Further, this guide rail 13 is provided separate or is disconnected from a return guide rail not shown.

Figure 2A:
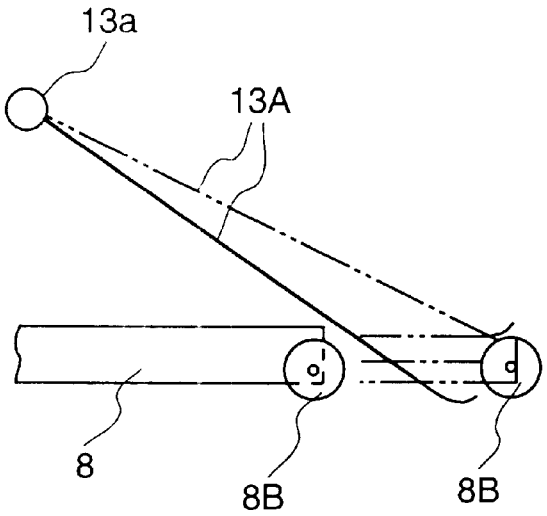
FIGS. 2A and 2B are diagrams illustrating a reverse action of a step board indicated in the bottom section of FIG. 1, where
Figure 2B:
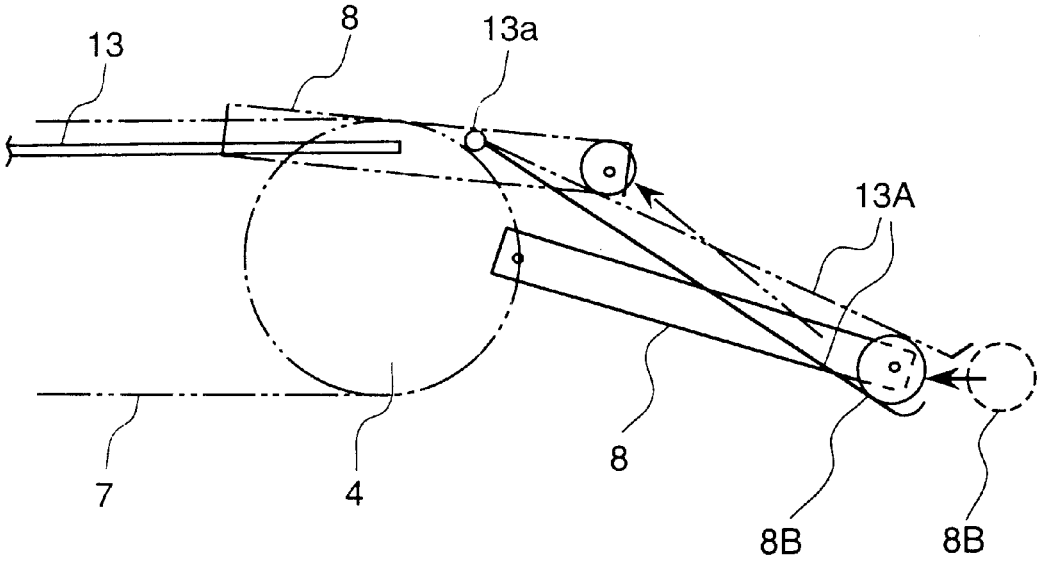
Figure 3:
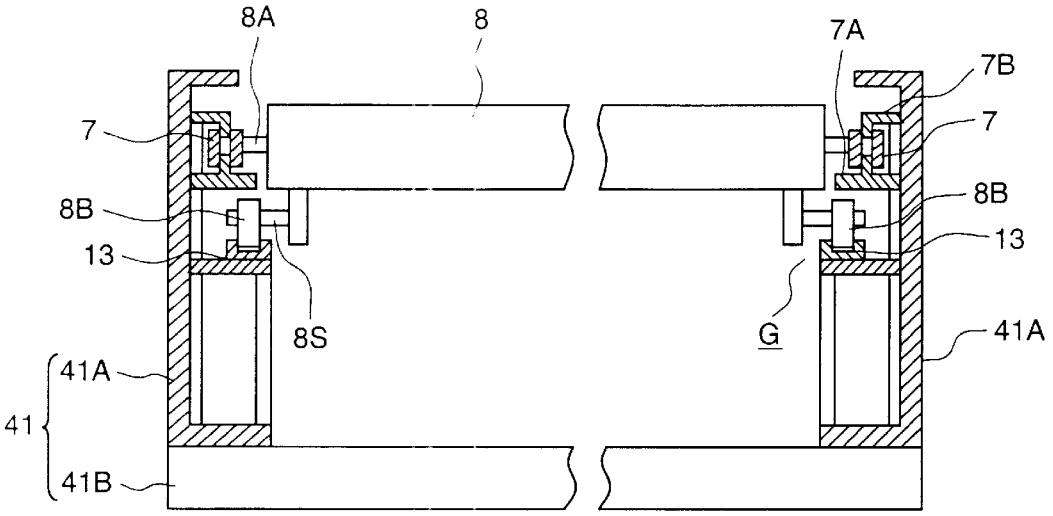
FIG. 3 is a front view, partly in cross-section, of FIG. 1.

With reference to FIGS. 2A, 2B, a pin 8A protruding from the base end portion in the lateral direction of a step board 8, which is positioned toward the upper floor therein, is connected rotatably to a connection portion of drive chain 7. Further, a horizontal transfer roller 8B is rotatably mounted on axis 8S which protrudes in a lateral direction from both sides of each step board 8 positioned toward the lower floor 2. Guide rail 13 has a structure, which has a groove on its upper surface to guide movement of horizontal transfer roller 8B. 7A and 7B portions of depict a guide plate for guiding the drive chain 7.

When operating the above-mentioned escalator apparatus, upper sprocket 5 is driven by a drive source 9, such as a motor and a controller (not shown), at an appropriate speed. By selecting a forward or reverse operation of the drive source 9, drive chain 7 can be moved freely in upper or lower directions.

In an ascend operation, step board 8 that is supported pivotally by drive chain 7 at its base end portion via pins 8A ascends while maintaining its level state in response to movement of the drive chain 7 in the direction of arrow P. In a descend operation, step board 8 that is supported pivotally by drive chain 7 at its base end portion via pins 8A is allowed to descend while maintaining its level state in response to movement of drive chain 7 in the direction of arrow Q.

In a case where step board 8 is moved circularly along its forward direction and return direction, a reversal action for reversing the direction of motion of step board 8 between the forward and the return routes, in particular, in the vicinity of lower sprocket 4, will be described with reference to FIGS. 2A, 2B.

In the vicinity of lower sprocket 4, an upper transfer guide rail 13A, which is disconnected from the above-mentioned guide rail 13, is provided. This upper transfer guide rail 13A is pushed upward from the bottom immediately before horizontal transfer roller 8B of step board 8 passes to change its direction of movement from the return route to the forward route, as indicated by dot and chain line in FIG. 3. At the next instant, the upper transfer guide rail 13A drops to allow the horizontal transfer roller 8B to ride over the upper transfer guide rail 13A in the reverse direction to get on guide rail 13, as indicated by dot and chain line in FIG. 2B. In FIG. 2B, numeral "13*a*" depicts a pivotal axis, that is, a rotary axis of the upper transfer guide rail 13A. By provision of such a delivery (transfer) mechanism or guide means for transferring step board 8 between the forward and the return routes, the step board 8 can be moved therebetween with its upper surface constantly facing upward.

As described above, at the lower floor 2, the step board 8 is allowed to move along an external periphery of lower sprocket 4 with its upper surface constantly facing in the upper direction. On the other hand, at the upper floor 3, a pair of upper sprockets 5 are mounted on a different axis so that the step board 8 can pass a gap between the pair of upper sprockets 5.

By way of example, in case step board 8 is connected to drive chain 7 at its end portion on the side toward the lower floor 2, it is necessary to arrange the elements in a reversed mode such that the step board 8 is moved along the external periphery of the upper sprocket 5 at the upper floor 3 with its upper surface facing upward, and the step board 8 moves through a gap between the pair of lower sprockets 4 at the lower floor 2.

As described above, when the step board 8 is coupled with drive chain 7 at the forward end portion of step board 8 moving in its forward direction, the step board 8 passes between the pair of sprockets 5 located in the forward direction of movement thereof. Alternatively, when the step board 8 is coupled with drive chain 7 at the backward end portion of step board 8 moving in its forward direction, it is arranged for the step board 8 to pass between the pair of sprockets 4 located in the backward direction of movement thereof, thereby ensuring that the step board 8 will be able to smoothly travel circularly along the forward and the return routes. However, it is preferable the step board 8 to pass through the pair of sprockets 5 which are provided on the side connected to drive source 9, because it is easier to construct.

Figure 4:
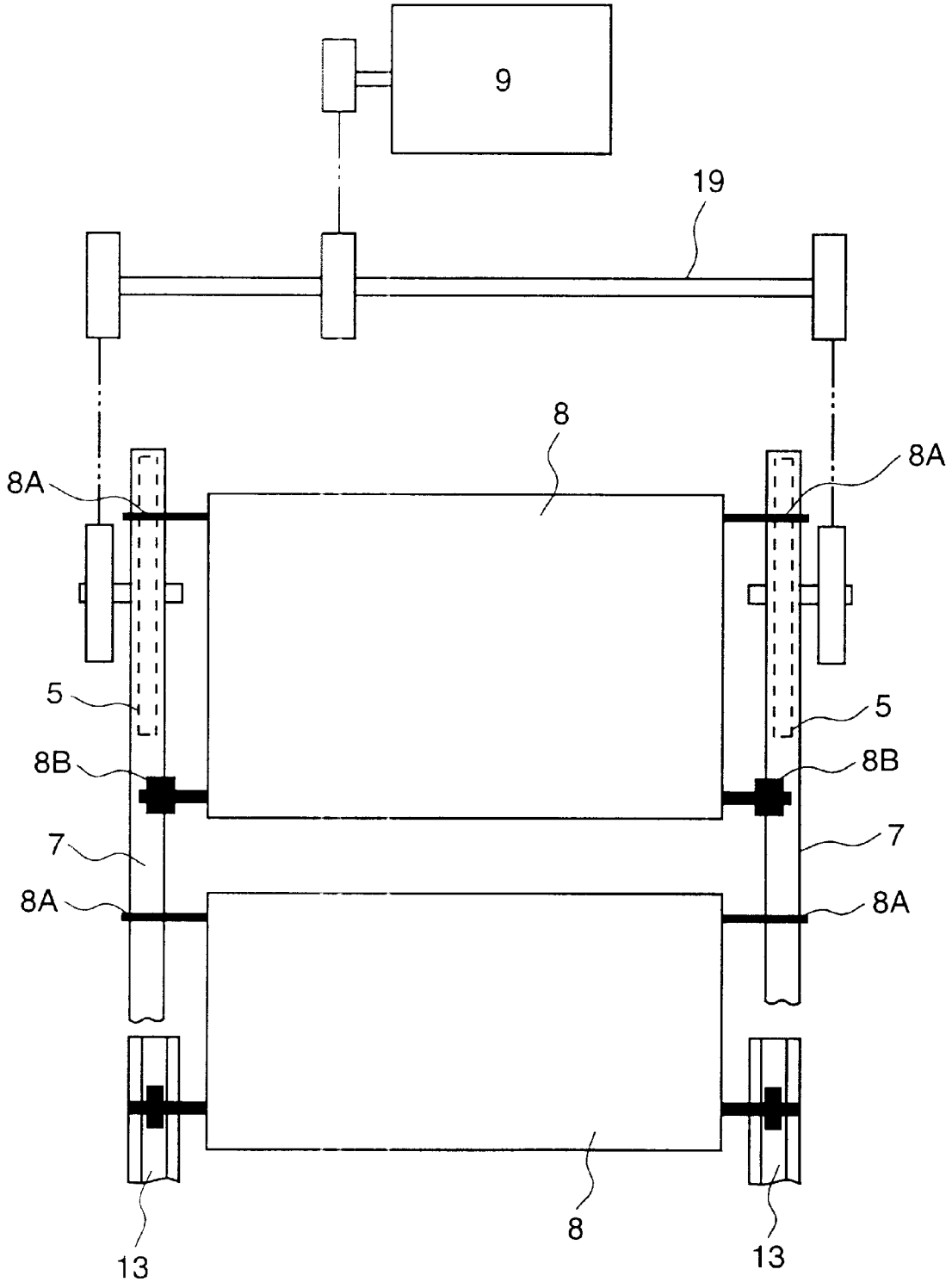
FIG. 4 is a plan view of an upper section of FIG. 1.

With reference to FIG. 4, a portion beyond the end of guide rail 13 is provided in front of upper sprocket 5 in order to allow the horizontal transfer rollers 8B to drop from the forward route to the return route without causing the step board 8 to be rotated by 180°. Further, the transfer mechanism is constructed in a gap formed between the pair of upper sprockets 5, 5 and the pair of lower sprockets 4, 4 for allowing step board 8 to reverse freely in its direction of movement while its upper surface constantly faces the upper direction. Numeral 19 depicts a counter axis for distributing power from drive source 9 to the symmetrically disposed pair of upper sprockets 5.

In the aforementioned embodiment of the invention, because the direction of movement of step board 8 can be reversed without rotation thereof by 180°, the height of the support frame structure 41 can be reduced. As a result, the space required for installation thereof can be reduced, thereby allowing its installation, for example, on a staircase having a limited ceiling space without need for additional construction work.

Figure 5:
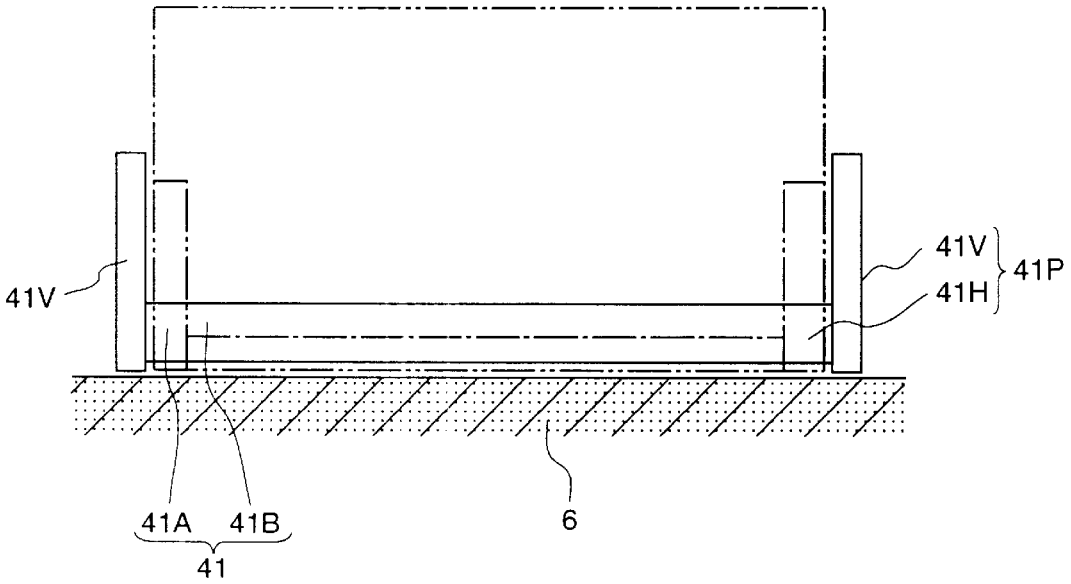
FIG. 5 is a cross-section indicating a state of installation on a stairway of the apparatus of FIG. 1.

Now, with reference to FIG. 5, an example of installation of the escalator apparatus according to the aforementioned arrangement on staircase 6 will be described in the following.

A plurality of stair case anchor units 41P, which are mountable on stair case 6 and comprise a pair of right and left side step anchor feet 41V, 41V and a connector 41H for connecting said pair of right and left side step anchor feet in a horizontal direction, are provided integral with bottom frame 41B or side frame 41A of support frame structure 41 of the passenger transportation conveyor by being fixed thereto.

This step anchor unit 41 may be provided on every step or with an interval of every several steps. Materials for step anchor unit 41P can be selected appropriately as a pipe, plate, resin and the like. Further, although connecting member 41H is preferred to be provided integral with step anchor feet 41V, 41V (triangular flat plate in the embodiment), it is not limited to such an element having a flat bottom surface, and may be provided as a bar detachable with a pair of feet 41V, 41V. Further, connector member 41H alone may be provided as a foldable member.

Step anchor unit 41P may be simply placed on the staircase 6 as required or removed therefrom freely, or it may be permanently installed so as to be fixed to staircase 6 as a permanent escalator apparatus.

Figure 6:
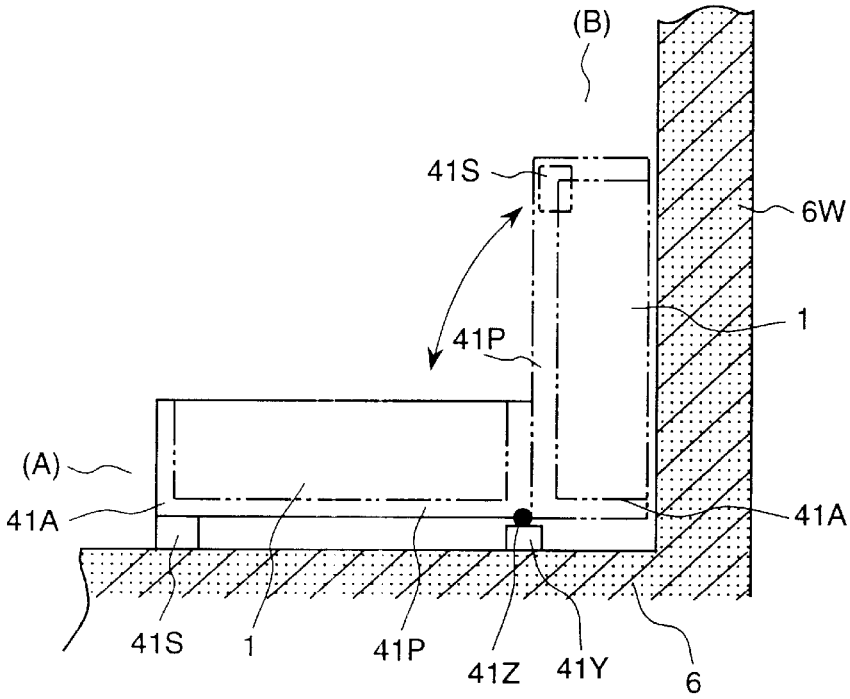
FIG. 6 is a cross-section indicating another state of installation on a stairway of the apparatus of FIG. 1.

With reference to FIG. 6, a pivotal axis 41Z extending in a longitudinal direction of the stair case and a pivot mount table 41Y mounting the pivotal axis 41Z thereon are provided on step 6 and are spaced from step side wall 6W by the distance of a height of side frame 41A in order to provide for a mechanism to allow step anchor unit 41P to be pivotally supported on the pivot mount table 41Y. Thereby, step anchor unit 41P can be positioned alternately in position (B) in a storage state in an erected condition along step side wall 6W together with escalator apparatus 1, when there is no need to use the passenger transportation conveyor 1, thereby allowing use of the step as a normal step 6, or in position (A) in a serviceable state to support an escalator placed in a horizontal position along step 6.

Further, in FIG. 6, a retractable support table 41S is provided in step anchor unit 41P. This retractable support table 41S is locked in the position (A) so as to protrude from the bottom surface of step anchor unit 41P when in use to support the bottom surface of step anchor unit 41P at the same level as that of pivot mount table 41Y, or it can be locked in the retracted position (B) so as to be retracted within step anchor unit 41P, thereby ensuring no protrusion from the bottom surface therefrom.

In the aforementioned structure of the embodiment of the invention, an endless belt (which is flexible), a wire or any other type of drive belt may be used in place of drive chain 7.

A second embodiment of the invention will now be described with reference to FIG. 7.

An escalator apparatus according to the second embodiment of the invention is installed on staircase 6 extending from lower floor 2 to upper floor 3. A pair of drive chains 7 are provided between a pair of upper sprockets 5 on the upper floor and a pair of lower sprockets 4 on the lower floor. A plurality of step boards 8 are coupled to these drive chains 7. These drive chains 7 are driven by drive source 9, which is a motor, in the direction of arrow A, thereby transporting passengers from lower floor 2 to upper floor 3.

Each step board 8 is connected pivotally (free to change its angle) with drive chain 7 at its end portion facing upper floor 3, and has a riser plate 10 at its another end portion facing the lower floor. This riser plate 10 is placed in a drop position in a transport region, which is a part of an upper stretch support frame region (forward side) for transporting passengers, so as to close a gap between it and the next step board 8 to follow. On the other hand, in a lower stretch support frame region (return side), the free end portion of riser plate 10 remote from the step board 8 is positioned juxtaposed to step board 8 in a retracted position such that the riser plate 10 and step board 8 become approximately parallel with each other when moving. Thereby, the distance between the upper path support frame region and the lower path support frame region can be minimized, thereby providing a compact escalator apparatus with its height substantially reduced. Therefore, when this escalator apparatus 1 of the invention is installed on staircase 6, a sufficient ceiling space can be ensured.

A base end portion of riser 10 is mounted pivotally (free to change its angle of rotation) on a pivotal axis which extends in a direction of the width of step board 8, provided at the other end portion of the step board 8. A gear is fixed on this pivotal axis, and a guide cam of a folding fan shape is meshed with this gear. The guide cam has a circular arc periphery to mesh with the aforementioned gear, and by displacement of its angle, the riser 10 is subjected to angular displacement and is folded into its retracted position.

Figure 7:
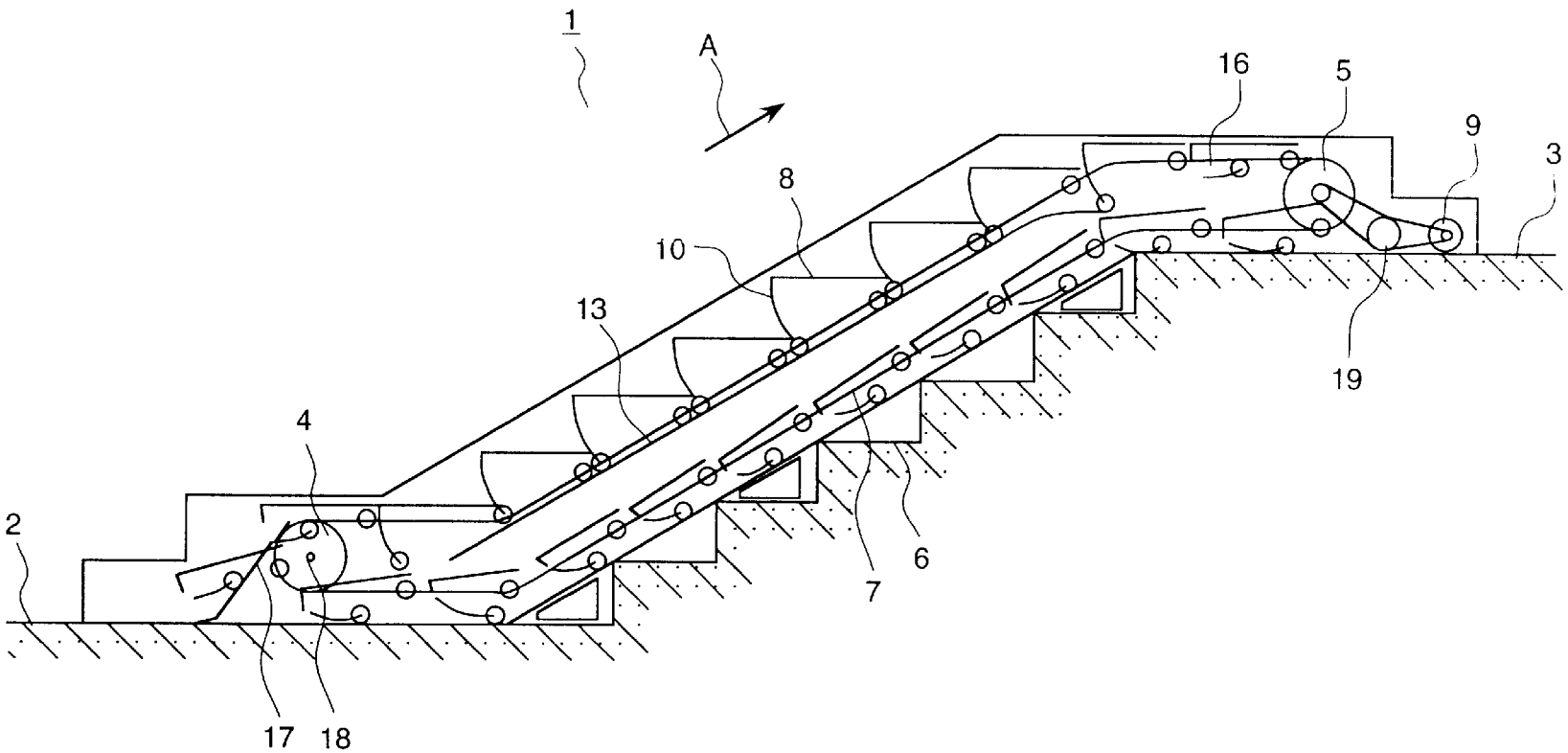
FIG. 7 is a diagram showing a side view of an escalator apparatus according to a second embodiment of the invention.

As shown in FIG. 7, in the transport region in the upper path support frame region, a suspending end portion of riser 10 coupled with step board 8 is guided by a guide rail 13 which is provided in an intermediate inclined section along the stair case so that riser 10 is in its close position, and the step board 8 is moved while maintaining its flat surface state. Cam guide roller 16 is provided toward upper floor 3, namely, in the vicinity of an end portion of the upper path support frame region to make contact with step board 8 moving horizontally on the side of upper floor 3, thereby causing the guide cam to change its angle of contact by cam guide roller 16 along with movement of step board 8, thereby allowing the riser 10 to be positioned in its retracted position immediately before arriving at upper sprocket 5. Therefore, riser 10 is transferred from the upper path support frame region to the lower path support frame region in a state where it is in the retracted position. This folding mechanism for folding riser 10 in the retracted position is provided by each mechanism of riser 10 and cam guide roller 16 as described above.

Further, at the lower floor 2, an upper transfer guide rail 17 is provided for transferring riser 10 in the retracted position from the lower path support frame region to the upper path support frame region. Upper transfer guide rail 17 is pivotally supported at its upper end portion so as to be free to change its angle of rotation. When step board 8 moves toward the left in the lower path support frame region in FIG. 7, a bottom end portion of the upper transfer guide rail 17 is kicked upward, and when the direction of movement of step board 8 is reversed so as to advance in the right-hand direction, guide roller 12 is allowed to ride on the upper transfer guide rail 17 so as to be guided in the upper direction. Therefore, because the riser 10 is transferred from the lower path support frame region to the upper path support frame region in the retracted position, the riser 10 is prevented from interfering with a rotary axis 18 of the lower sprocket 4. In the vicinity of the starting point of the upper stretch support frame region, the riser 10 having passed the bottom sprocket 4 returns to its original suspended position.

By displacing riser 10 as described above, a plurality of step boards 8 can be transferred while the surfaces of the step boards face in the upper direction from the upper stretch support frame region to the lower stretch support frame region or vice versa.

Figure 8:
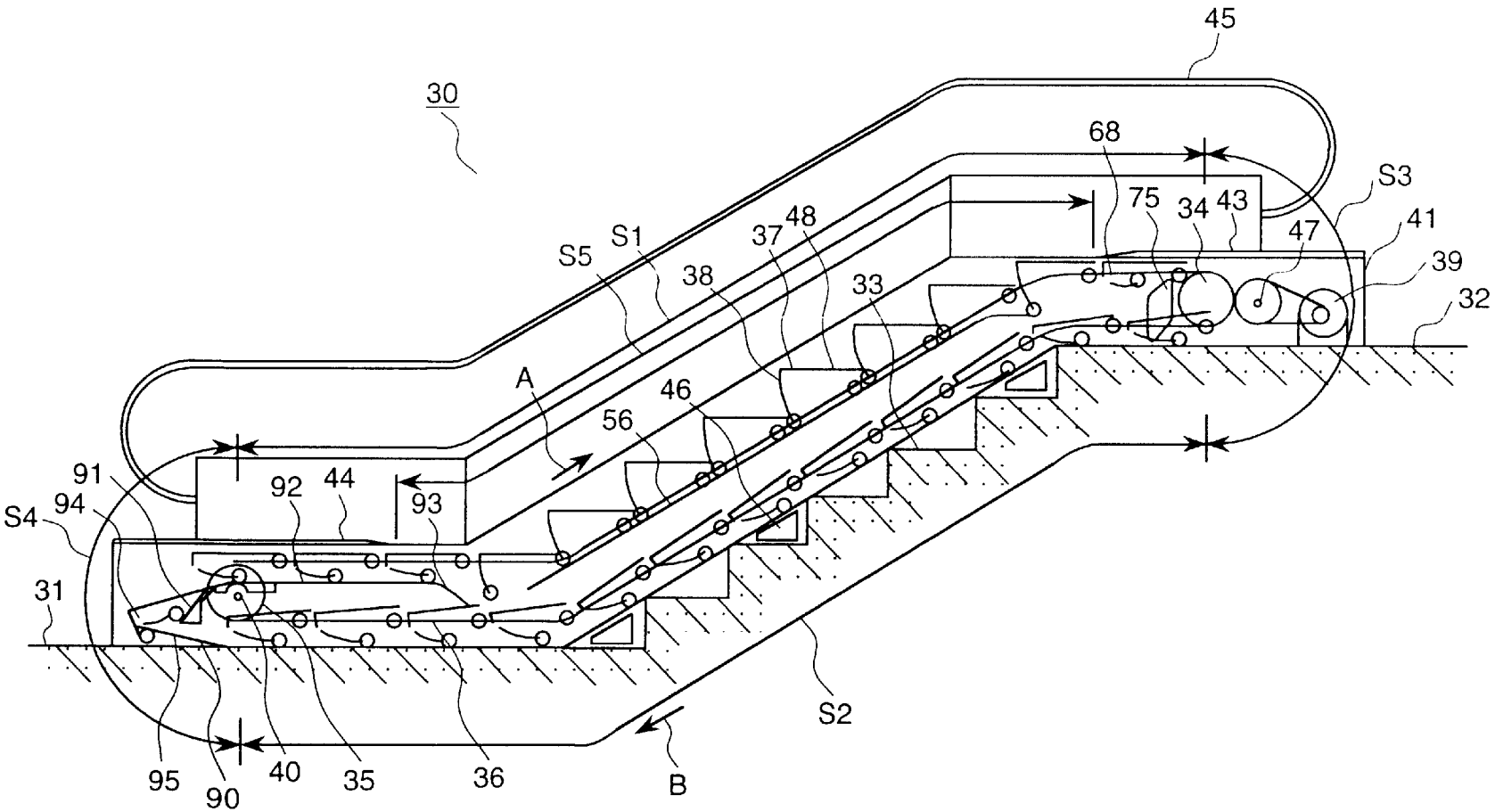
FIG. 8 is a longitudinal cross-sectional side view of an escalator apparatus according to a third embodiment of the invention.

Now, a third embodiment of the invent ion will be described with reference to FIGS. 8 and 9 in the following.

Escalator apparatus 30 according to the third embodiment of the invention is installed on a staircase 33 extending from lower floor 31 in a lower direction to upper floor 32 in an upper direction. This escalator apparatus 30 has a support frame structure 41 installed so as to extend from lower floor 31 to upper floor 32. A pair of upper sprockets 34 disposed apart from each other in an axial direction perpendicular to the plane of FIG. 8 are provided on support frame structure 41 on the side of the support frame at the upper floor 32 and are supported rotatably around an axial line extending in a direction of the width thereof. In the same manner, a pair of lower sprockets 35 separated from each other in a width direction thereof are provided rotatably on the support frame structure 41 on the side of the support frame at the lower floor 32.

A pair of drive chains 36, such as a pair of endless roller chains, are wound around these upper and the lower sprockets 34 and 35 between the upper and the lower floors, and a plurality of step boards 37 are coupled between the pair of these drive chains 36. Each step board 37 is connected to drive chains 36 at its forward end portion, namely, at its end portion facing the upper floor 32, and is mounted so as to be free to change its angle of rotation around an axial line extending in the width direction described above. A base end portion (upper end portion) of riser 38 is connected so as to be free to change its angle of rotation to the other end portion of each step board 37 facing opposite to the forward direction, i.e., portions facing the lower floor 31, around an axial pivot line extending in the direction of the width.

At the upper floor 32 portion of the support frame structure 41, a drive source 39, such as a motor, is provided. A drive force from drive source 39 is transmitted to an intermediate axis 47. Gears provided on both sides of this intermediate axis 47 which mesh with gears fixed on the pair of upper sprockets 34 transfer this drive force to the pair of upper sprockets 34. Further, the drive force from the drive source 39 may be transmitted to each upper sprocket 34 also by using a chain, as in the normal escalator apparatus.

As described above, the drive source 39 allows the drive chain 36 to move each step board 37 in a direction from the lower floor 31 to the upper floor 32 along the upper path support frame region S1.

In the following description, the movement of a step board 37 along the upper path support frame region S1 in an upward direction, as indicated by arrow A, is defined to be the upward direction A, and movement of step board 37 in the lower path support frame region S2 in a downward direction, as indicated by arrow B, is defined to be the downward direction B.

Each upper sprocket 34 has a structure to allow for a drive force to be transmitted thereto via gears on the intermediate axis 47 and has no axle extending between the pair of upper sprockets 34, thereby allowing the step board 37 and the riser 38 to pass through a gap between the pair of the upper sprockets 34. On the other hand, the pair of the lower sprockets 35 have a common axle 40; therefore, riser 38 is transferred in the upper direction as disposed in its retracted position in order to avoid the aforementioned axle 40, as will be described later.

On the lower floor side of the support frame structure 41, a lower boarding floor 44 is provided for passengers to step on in the forward direction. On the upper floor side of the frame structure 41, an upper boarding floor 43 is provided likewise. Each Step board 37 traveling on a circular path moves horizontally in line with the lower boarding floor 44 on the lower floor side, then emerges from the lower boarding floor 44, rises along stair case 33, moves horizontally along upper floor 32, and submerges under upper boarding floor 43. This region in the upper path support frame region S1 for drive chain 36 between the lower boarding floor 44 and the upper boarding floor 43, where each step board 37 is exposed externally, is defined to be a transport region S5.

Each step board 37 is carried so as to maintain its step surface 48 for boarding a passenger at a horizontal level in this transport region S5, and each riser 38 associated with each step board is positioned at its close position in which it is suspended in the bottom direction, thereby closing the vertical gap formed between a preceding step board and a subsequent step board.

Further, a region of drive chain 36 in the vicinity of the upper sprocket 34, where the chain is wound around the sprocket 34, is defined as a lower transfer region S3. In this lower transfer region S3, each step board 37 is moved from the upper path support frame region S1 to the lower path support frame region S2 while maintaining its step surface 48 facing in the upper direction. In the same manner, a portion thereof in the vicinity of lower sprocket 35, where the chain is wound around the sprocket 35, is defined to be an upper transfer region S4. In this upper transfer region S4, each step board 37 is allowed to move from the lower path support frame region S2 to the upper path support frame region S1 with its step surface 48 facing in the upper direction.

A pair of railings are erected on both sides in a lateral direction of support frame structure 41, and a handrail 45 is guided endlessly along the periphery of each of the pair of railings. This hand rail 45, which is driven circularly by a drive force from drive source 39, moves at the same speed as drive chain 36. Therefore, passengers boarding on the lower boarding floor 44 from the lower floor 31 when gripping the hand rail 45 and stepping onto the step surface 48 of step board 37 will be transported up to the upper floor 32.

The support frame 41 is fixed to lower floor 31, upper floor 32 and staircase 33 using a simple fixture 46. This simple fixture 46 can be fixed in a removable manner using a concrete bolt and the like. Alternately, a hole bore may be provided in the lower floor 31, upper floor 32 and stair case 33 to receive each bolt of the simple fixture 46, so that the escalator apparatus of the invention can be installed easily by insertion of the bolt of the simple fixture 46 into the hole in the floors. By such a method of installation, the construction work to fasten or unfasten the concrete bolt during installation or removal of the escalator apparatus 30 on or from the stair case can be reduced, thereby enabling easier installation and removal of the escalator apparatus 30.

Further, the support frame structure 41 is divided into a plurality of sections, and the maximum length of the support frame is selected preferably to be less than 5 m. Therefore, transportation, assembly and removal of the escalator apparatus of the invention will become substantially easier.

Figure 9:
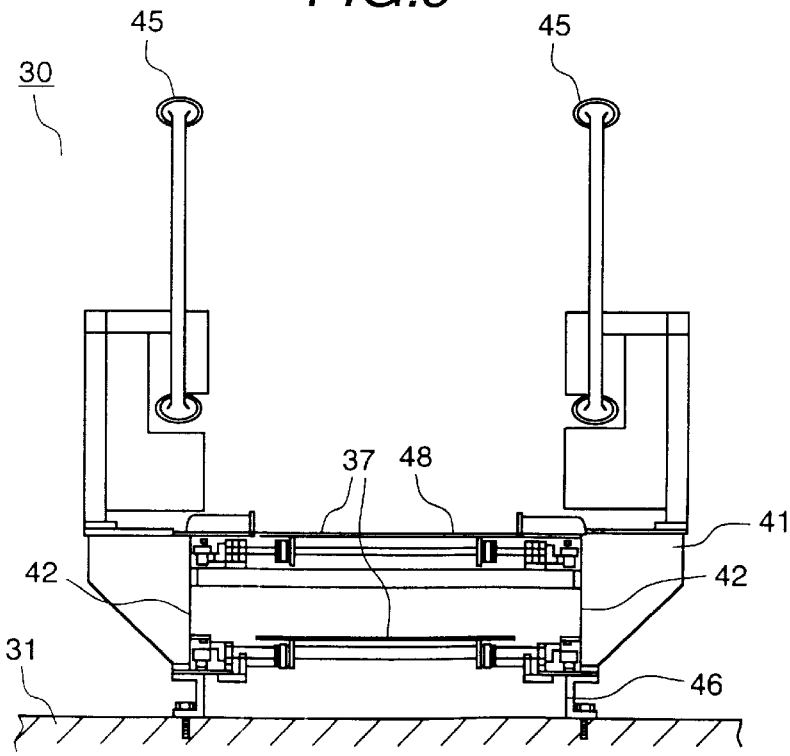
FIG. 9 is a cross-section, partly enlarged, of a portion of FIG. 8.
Figure 10:
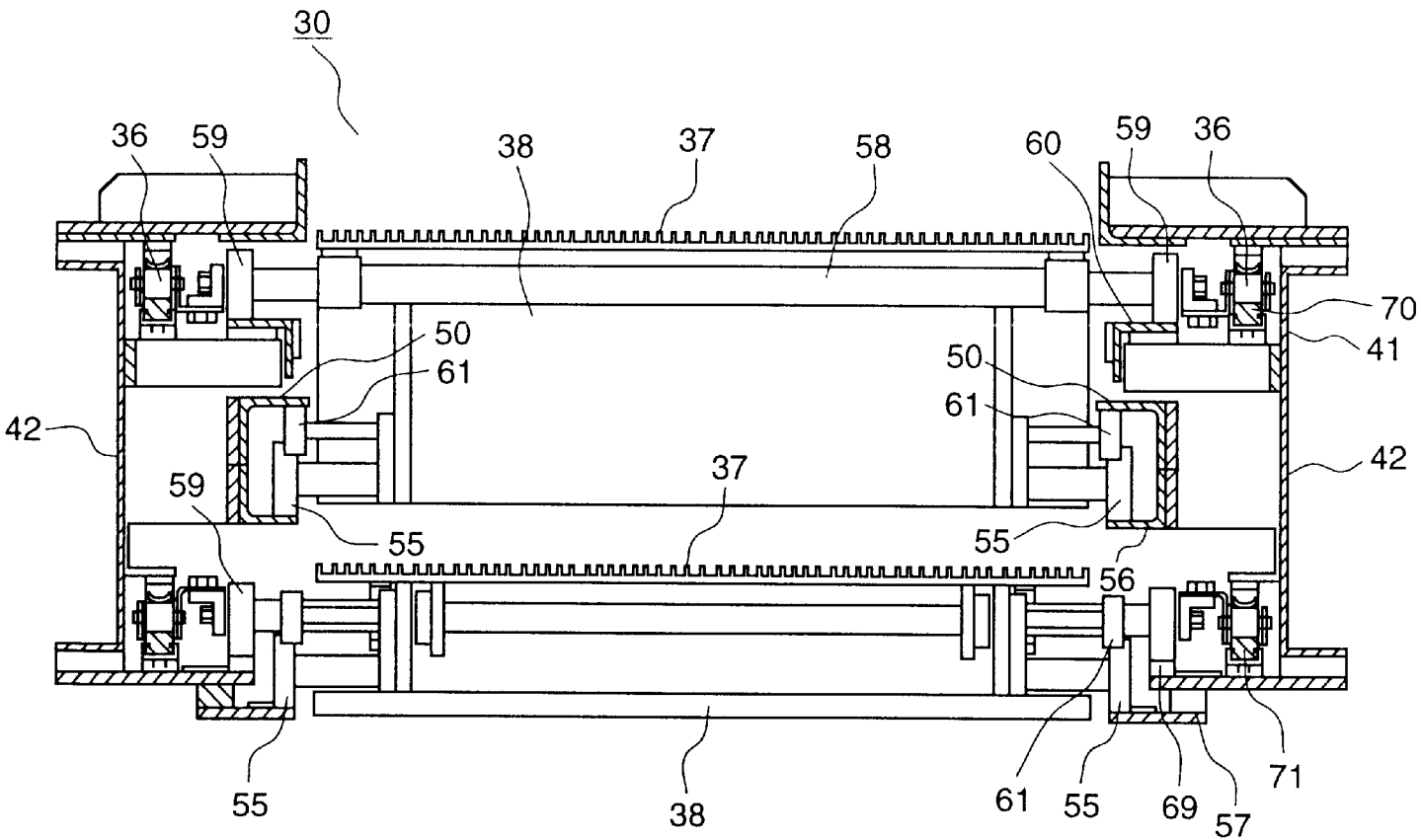
FIG. 10 is a longitudinal enlarged view of a portion in the vicinity of step boards in FIG. 9.
Figure 11:
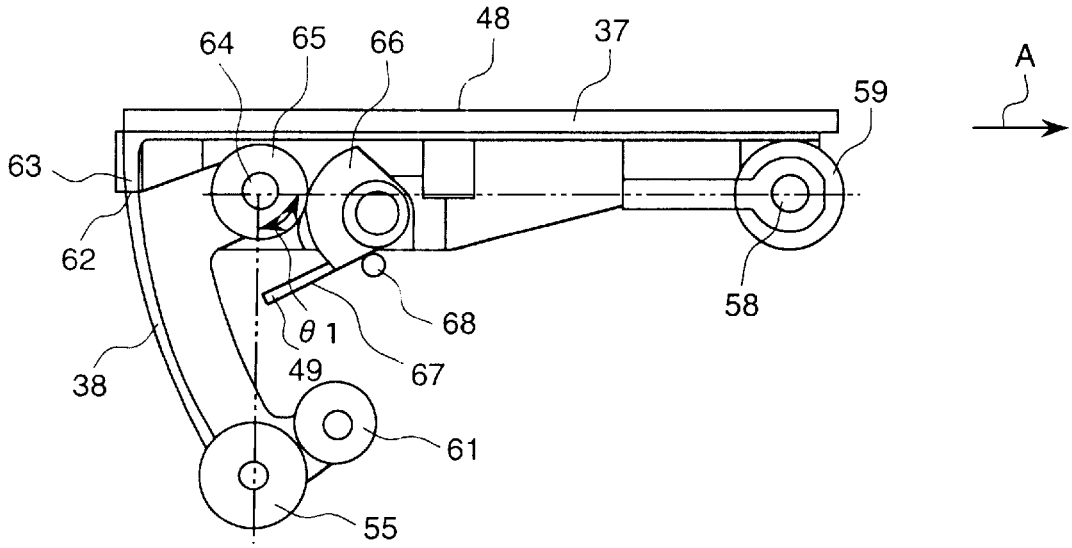
FIG. 11 is a side view of a step board in a state having its riser disposed at a closed position.
Figure 12:
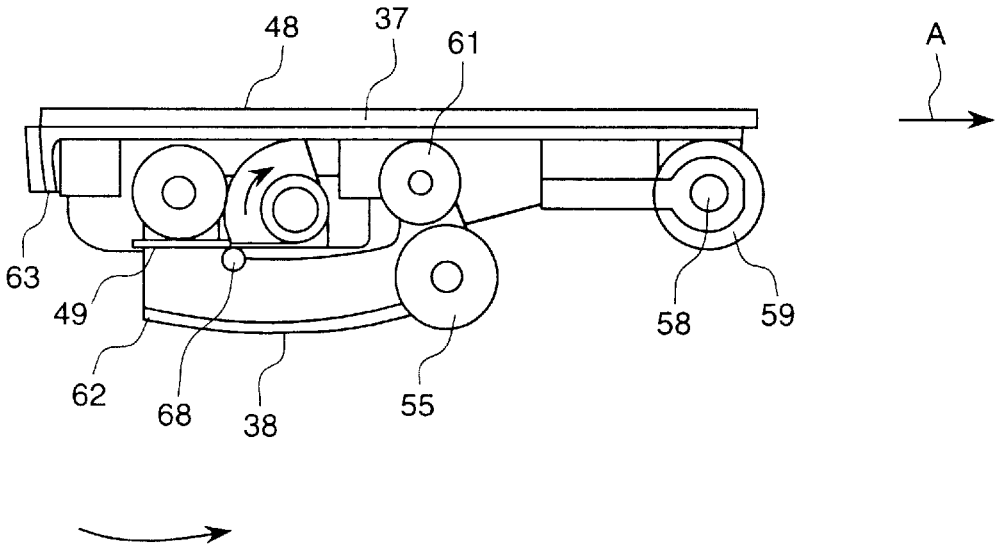
FIG. 12 is a side view of the step board in a state having its riser disposed at a retracted position.

FIG. 10 is a cross-sectional view, enlarged in part, of FIG. 9 indicating a lateral cross-section in detail in the vicinity of step board 37. FIG. 11 is a side view indicating the state of a riser 38 which is positioned in its closed position. FIG. 12 is a side view indicating another state of the riser 38, which is positioned in its retracted position.

Riser 37 and step board 38 are comprised of a plurality of comb plates, respectively. In the transport region S5, respective comb plates of each riser 38 and each step board 37 associated therewith are meshed together.

In the end portion of step board 37 facing toward upper floor 32, there is provided a chain support axis 58 extending in an axial direction. On both sides of this chain support axis 58, there are provided the guide rollers 59 mounted so as to be free to rotate around the axial line of the chain support axis 58, and both end portions of this chain support axis 58 are connected to drive chain 36 so that the step board 37 is free to change its angle around the axial line of chain support axis 58. A step board upper guide rail 60 is provided along an intermediate inclined section of the upper path support frame region S1 on a side wall 42 of support frame 41, and a step board lower guide rail 69 is provided along an inclined section in the lower path support frame region S2, so that when step board 37 moves along the upper path support frame region S1, the guide roller 59 is guided along the step board upper guide rail 60, and when the step board 37 moves along the lower path support frame region S2, the guide roller 59 thereof is guided along the step board lower guide rail 69. Further, upper chain guide rail 70 is provided along the upper path support frame region S1, and drive chain 36 on the upper path support frame region S1 is guided along this upper chain guide rail 70. In the same manner, a lower chain guide rail 71 is provided along lower path support frame region S2, and drive chain 36 is guided along this lower chain guide rail 71 in the lower path support frame region S2.

In the vicinity of the other end portion of step board 37, there is provided angle displacement axis 64 extending in a lateral direction thereof so as to be free to change its angle of rotation, and to this angle displacement axis 64, a base end portion of riser 38 is fixed. At a free end portion of riser 38, there are provided a pair of guide rollers 55 at both ends of an axial line extending in a direction of the width. Further, a pair of small rollers 61 having a smaller diameter than that of guide roller 55 are provided in juxtaposition with the guide roller 55 at a position Slightly inward from the guide roller 55 in the width direction.

At the another end portion of step board 37, anchor end portion 63 pending downward is provided. When riser 38 is positioned at its closed position, upper end portion 62 of riser 38 is supported by the aforementioned anchor end portion 63 by making contact therewith. Riser 38 is allowed to hang down and is positioned at its closed position in its natural state.

Gear 65 is fixed at both ends of angle displacement axis 64 provided at the base end portion of riser 38. This gear 65 meshes with racks formed on a circular arc periphery of a guide cam 66 having a folding fan shape, which is positioned in juxtaposition with gear 65. Guide cam 66 is provided with a lever 49 fixed thereto, which lever 49 extends toward the other end portion of step board 37 and is inclined downwardly when riser 38 drops down toward its closure position. Further, a guide roller 68 is provided on the side of upper floor 32 of support frame structure 41, which makes contact with the lever 49 of the guide cam 66. When step board 37 has reached upper floor 32 and moves horizontally in the right-hand direction in FIG. 11, the aforementioned guide roller 68 makes contact with lever 49 of guide cam 66, and when step board 37 further advances in the right-hand direction, guide cam 66 rotates clockwise causing an angle displacement as indicated in FIG. 12. In response to this angle displacement, gear 65 meshed with this guide cam 66 and the riser 38 fixed on this gear 65 are rotated anti-clockwise causing an angle displacement until riser 38 becomes approximately parallel with step board 37 so as to be positioned at its retracted position. In this manner, riser 38 is ensured to be positioned in its retracted position immediately before it reaches the lower transfer region S3.

In support frame structure 41, there is also provided a riser upper guide rail 56 under the step board upper guide rail 60, which are separated in a vertical direction from each other. Riser lower guide rail 57 is provided likewise under the step board lower guide rail 69, but in a close proximity to the step board lower guide rail 69. When step board 37 travels in transport region S5, riser 38 associated with step board 37, the guide roller 55 of which is guided along riser upper guide rail 56, which is a guide rail for guiding step board 37 with its step surface 48 maintained at a level, is in its closure position. Further, when step board37 travels in the lower stretch support frame region S2, the riser 38, the guide roller 55 of which is guided by riser lower guide rail 57, advances in the retracted position. As described above, at least in the transport region S5 in the upper stretch support frame region S1, riser 38 is in the state of closure, and in the lower stretch support frame region S2, riser 38 is in the state of retraction; therefore, it becomes possible to reduce the space between the upper stretch support frame region S1 and the lower stretch support frame region S2, thereby providing for a compact-sized escalator apparatus 30 having a lower height.

Further, when riser 38 travels in the state of closure in the transport region S5, small roller 61 of riser 38 makes contact with small roller guide rail 50, which is provided parallel to the riser upper guide rail 56, from the bottom to the upper direction. Thereby, riser 38 is prevented from making angle an displacement to move toward the retraction side while traveling in the transport region S5, thereby ensuring that step board 37 will maintain its step surface 48 stably at a level.

Figure 13:
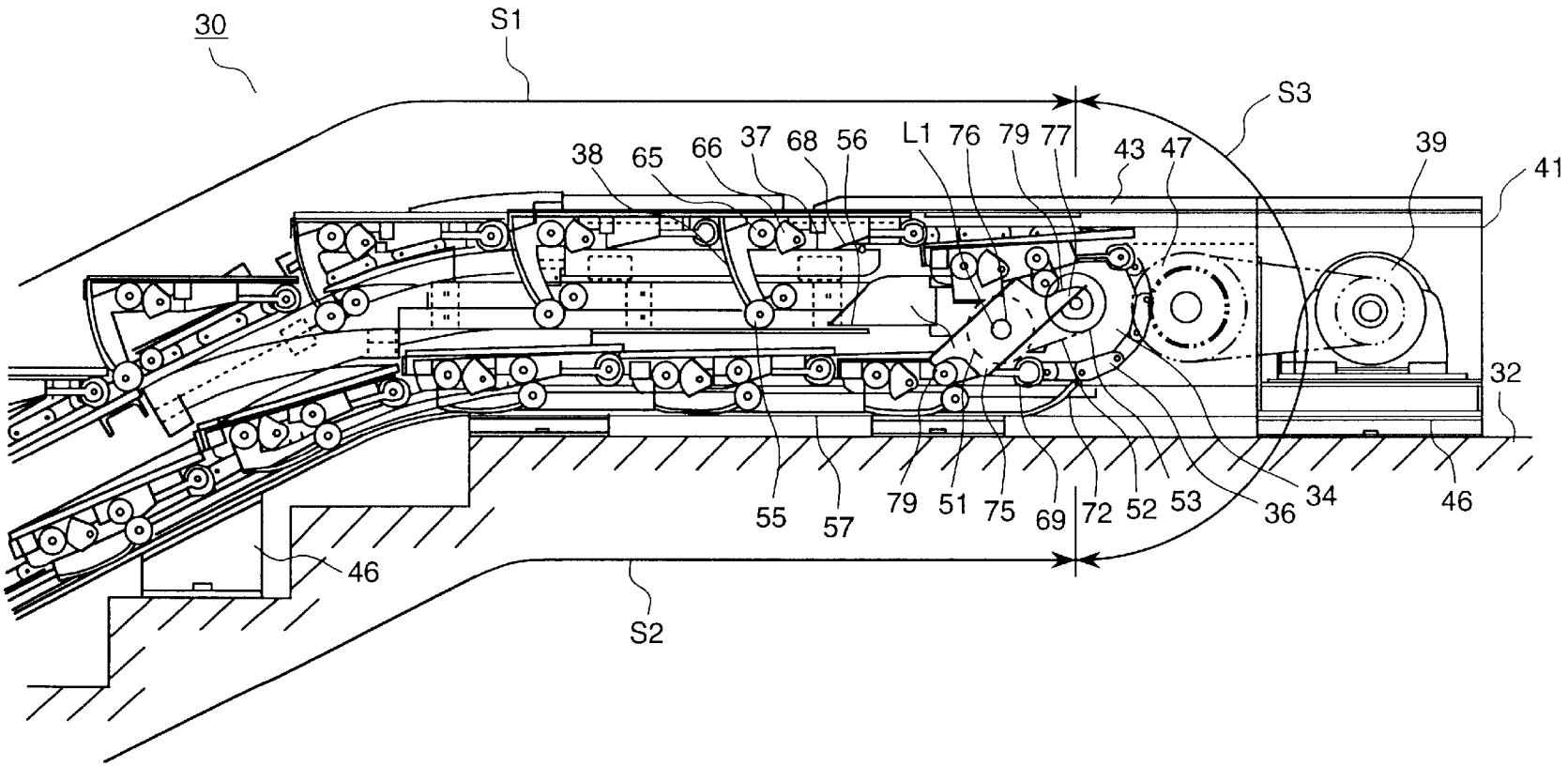
FIG. 13 is an enlarged side view in the vicinity of an upper floor in FIG. 8.

FIG. 13 is a side view of escalator apparatus 30 of the invention in the vicinity of upper floor 32 and with its side wall 42 removed. A pair of riser rotation guide means 75, which are separated from each other in a width direction are provided in the vicinity of upper sprocket 34 and are rotatably mounted on a rotor axis 76 having a rotation axial line L1 which is parallel to the axial line of upper sprocket 34 and is positioned internally of the drive chain 36.

This riser rotation guide means 75 is placed in a position where the riser upper guide rail 56, the step board upper guide rail 60 and the riser lower guide rail 57 are discontinued, so as to constitute a transfer mechanism for transferring step board 37 therebetween. Riser rotation guide means 75 is also provided with sprocket 51 coaxially. A chain 52 is stretch-mounted between this sprocket 51 and a sprocket 53 which is coaxially provided on upper sprocket 34, thereby rotating riser rotation guide means 75 at the same speed and in the same direction of rotation as upper sprocket 34. Riser rotation guide means 75 has a pair of receptor members 77, 78 formed symmetrically with respect to rotation axial line L1. When step board 37 is transferred along the lower transfer region S3 from the upper stretch support frame region S1 to the lower stretch support frame region S2, the aforementioned receptor members 77, 78 are arranged to support the guide roller 55 provided at the free end portion of riser 38 to enable the step board having its associated riser retracted in the retraction position to be guided from the upper stretch support frame region S1 to the lower stretch support frame region S2.

Figure 14:
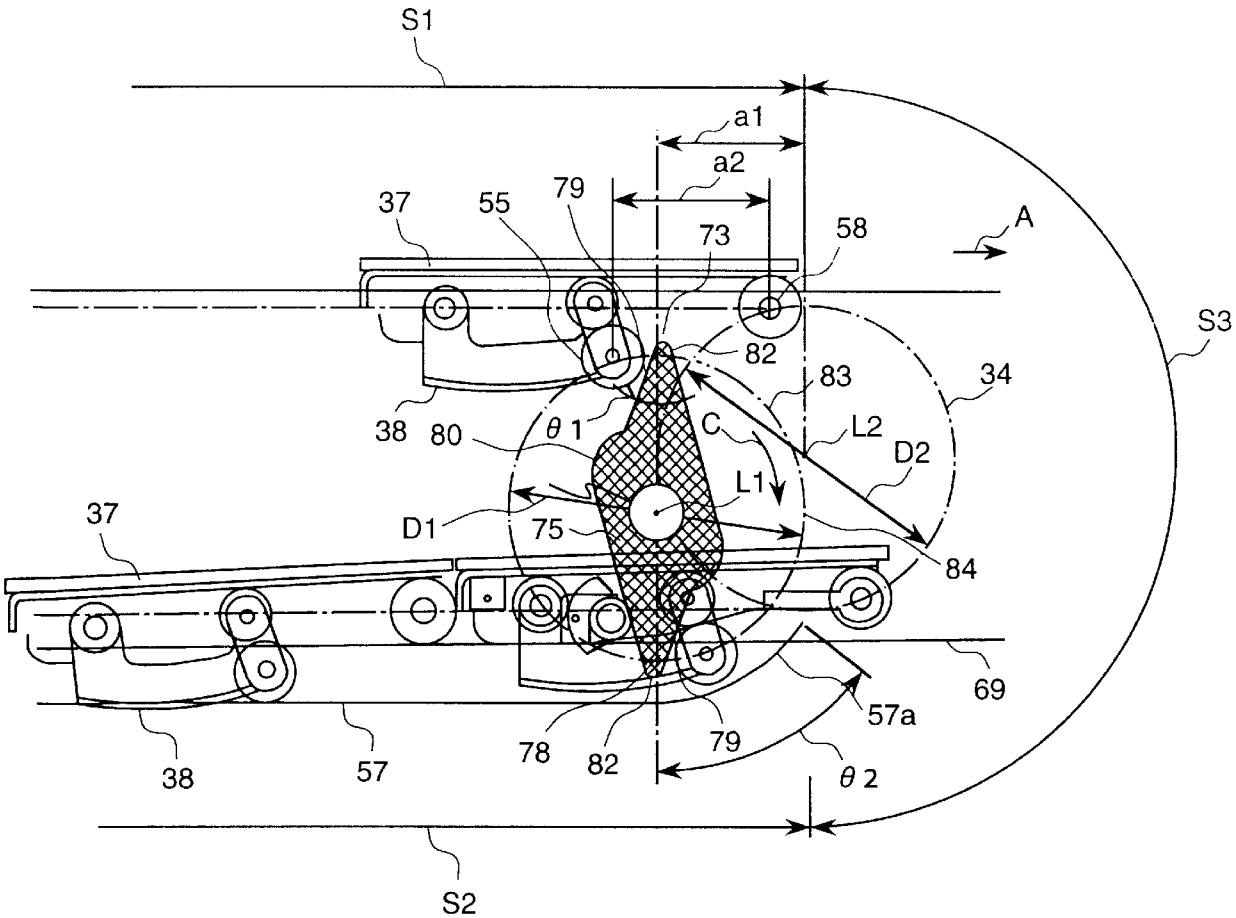
FIG. 14 is a still further enlarged side view of FIG. 8 indicating a state of its step board immediately before moving to a lower transport region.

FIG. 14 is an enlarged side view of a portion in the vicinity of riser rotation guide means 75 illustrating the condition immediately before the step board 37 reaches the lower stretch support frame region S3. Riser rotation guide plate 75 has a pair of receptor members 77, 78, each projecting externally approximately in radial directions, and each of these receptor members has a support surface 79. This support surface 79 is inclined at an angle θ1 from a virtual plane 73 drawn through rotation axial line L1 and respective edge portions 82 of respective receptor members 77, 78, in an opposite direction from a rotational direction C of riser rotation guide means 75 (in the clockwise direction in FIG. 14). Preferably, angle θ1 is selected from a range of $0°<\theta1<30°$. In case angle θ1 is less than 0°, there occurs a problem in that, when step board 37 reaches the lower transfer region S3, riser 38 cannot be held in the retracted position, and in case angle θ1 is greater than 30°, there occurs a problem in that the free end portion of riser 38 which os angularly displaced so as to be positioned in the retracted position immediately before arriving at the lower transfer region S3 will interfere with a corner section formed on each support surface 79 toward rotation axial line L1.

A locus of contact between guide roller 55 of riser plate 38 and support surface 79 when riser plate 38 is guided from the upper stretch support frame region S1 to the lower stretch support frame region S2 is represented by a circle as indicated by a virtual circle 83. Its diameter D1 is approximately the same as diameter D2 of upper sprocket 34; therefore, riser plate 38 is ensured to be transported from the upper stretch support frame region S1 to the lower stretch support frame region S2 in the state where it is retained in the retracted position.

Further, a front end portion 57*a* toward the upper floor 32 of a riser lower guide rail 57 for guiding guide roller 55 of riser 38 in the lower stretch support frame region S2 is formed to extend upward to make an angle θ2 coaxially around the center of rotation axial line L1 of riser rotation guide means 75. This angle θ2 is selected preferably from a range of $30°<\theta2<90°$, and more preferably, is set at 52°. In case angle θ2 is smaller than 30°, there arises a problem in that, when step board 37 descends to the lower stretch support frame region S2, guide roller 55 of riser 38 may collide with riser lower guide rail 57 severely, thereby producing a noise. Further, in case angle θ2 is larger than 90°, there arises a problem in that the front end portion 57*a* of riser lower guide rail 57 becomes too long, thereby filing to ensure a sufficient strength.

The riser plate guide means of the invention is comprised of the front end portion 57*a* of riser plate lower guide rail 57 and the riser plate rotation guide means 75 as described above.

The distance a1 between rotation axial line L1 of riser plate rotation guide means 75 and rotation axial line L2 of upper sprocket 34 is selected to be equal to a distance a2 between the axial line of chain support axis 58 of step board 37 and the rotation axial line of guide roller 55 of riser 38, which is folded in the retracted position.

When chain support axis 58 of riser 37 arrives at lower transfer region S3, the riser 38 is placed in the retracted position by the guide cam 66. At this time, the support surface 79 of one of receptor members 77 on the riser rotation guide means 75 is positioned so as to make contact with guide roller 55 of riser 38. Therefore, when guide plane 67 of lever 49, which is fixed on guide cam 66, moves away from guide roller 68, and riser plate 38 tends to change its angle to fall downward toward its position of closure, the support surface 79 of receptor member 77 makes contact with riser 38 from the bottom thereof, thereby preventing the same from angle displacement toward the position of closure.

Now, with reference to FIGS. 15–21, operation of the riser plate rotation guide means 75 will be described in the following.

Figure 15:
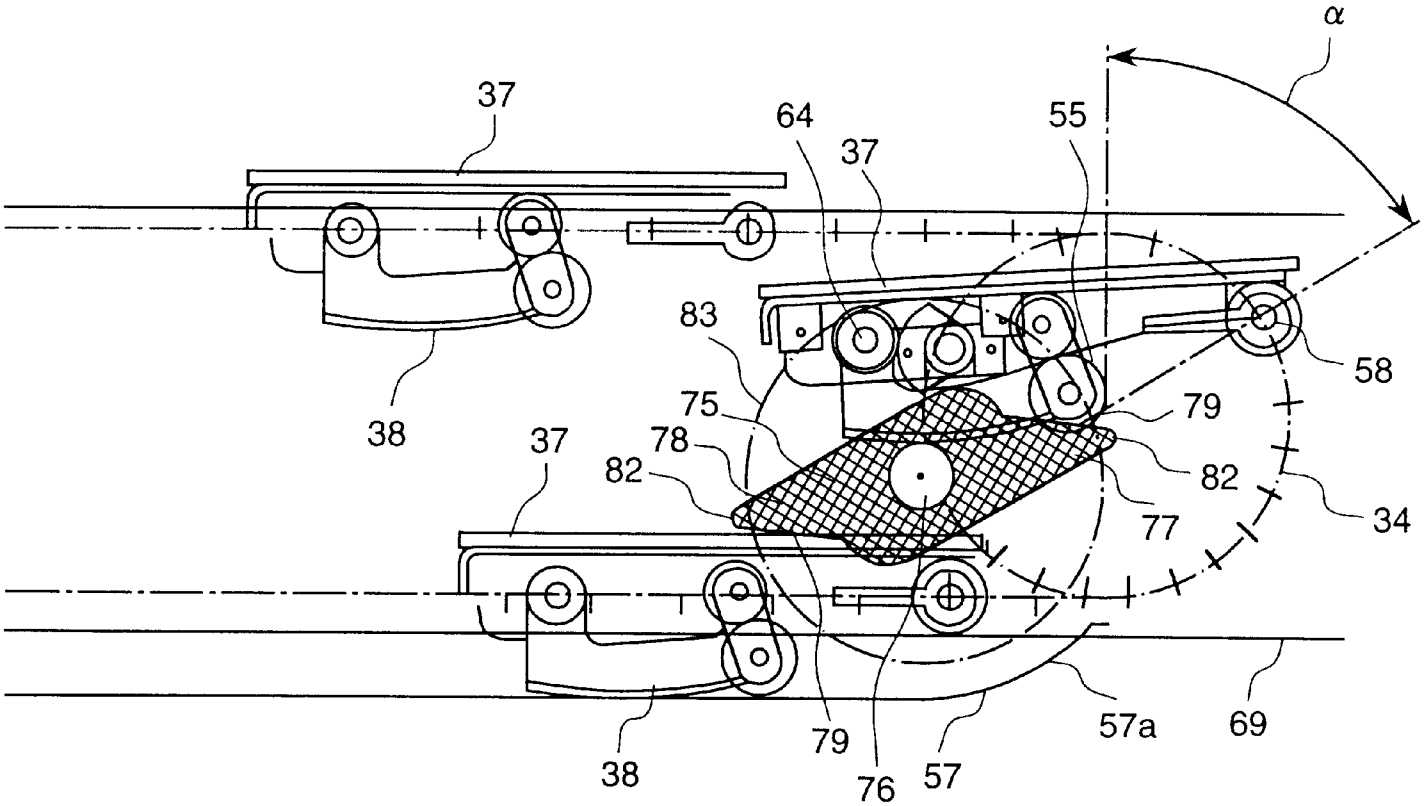
FIG. 15 is a side view indicating a state of an upper sprocket shown in FIG. 8 being rotated by angle $\alpha=57.6°$ from its reference angle.

FIG. 15 shows a state of operation thereof wherein upper sprocket 34 is rotated by angle $\alpha=57.6°$ from a reference position at which a front end portion of step board 37 arrives on an upper end portion of lower transfer region S3. At this time, riser plate rotation guide means 75 is also rotated by the same angle, and step board 37 is maintained approximately at a level and riser plate 38 is retained in the retracted position. In this case also, even if riser plate 38 tends to rotate around angle displacement axis 64 to change its angle toward the position of closure, its angle displacement is prevented by the support surface 79 of receptor member 77.

Figure 16:
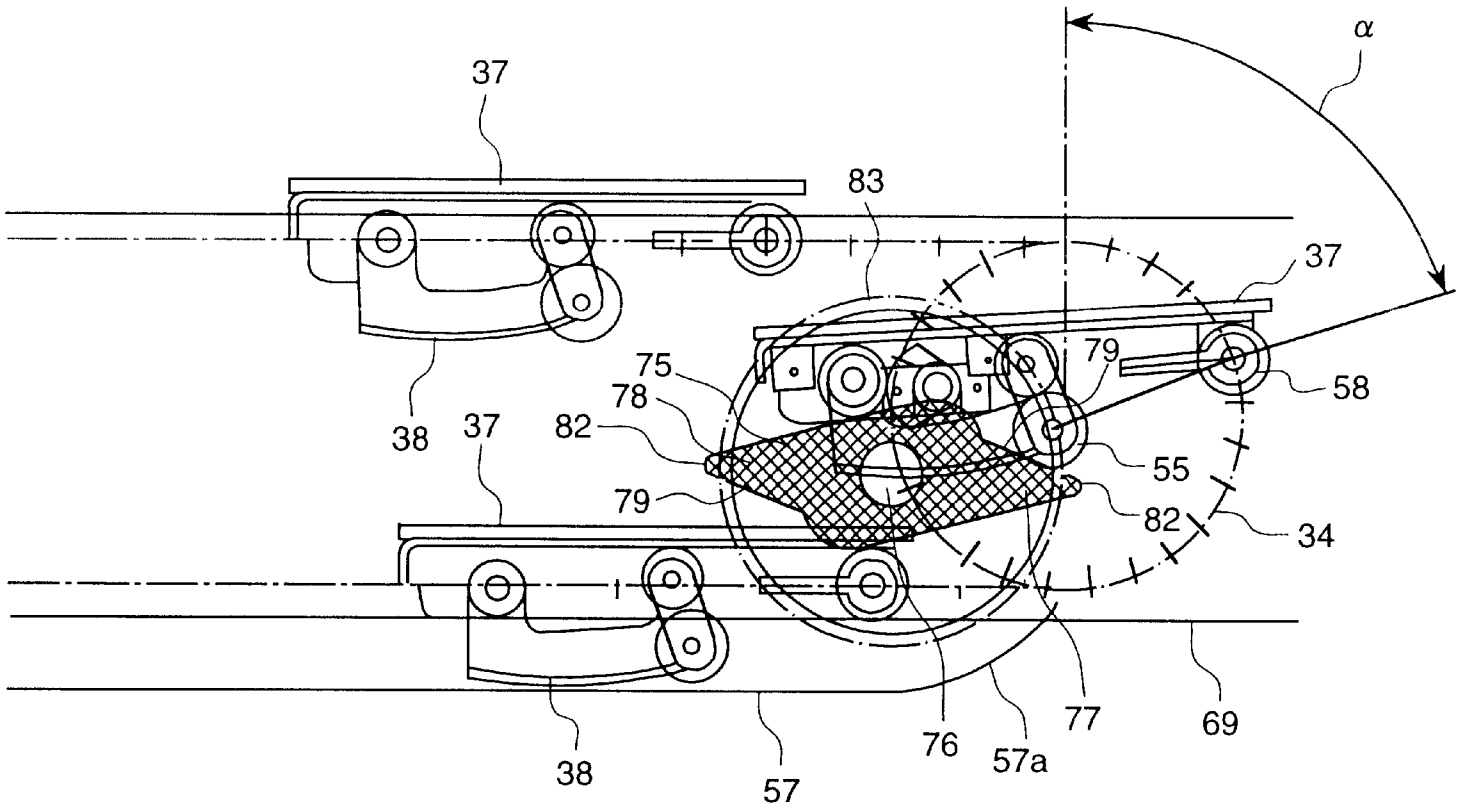
FIG. 16 is a side view indicating a state of the upper sprocket shown in FIG. 8 being rotated by angle $\alpha=72°$ from its reference angle.
Figure 17:
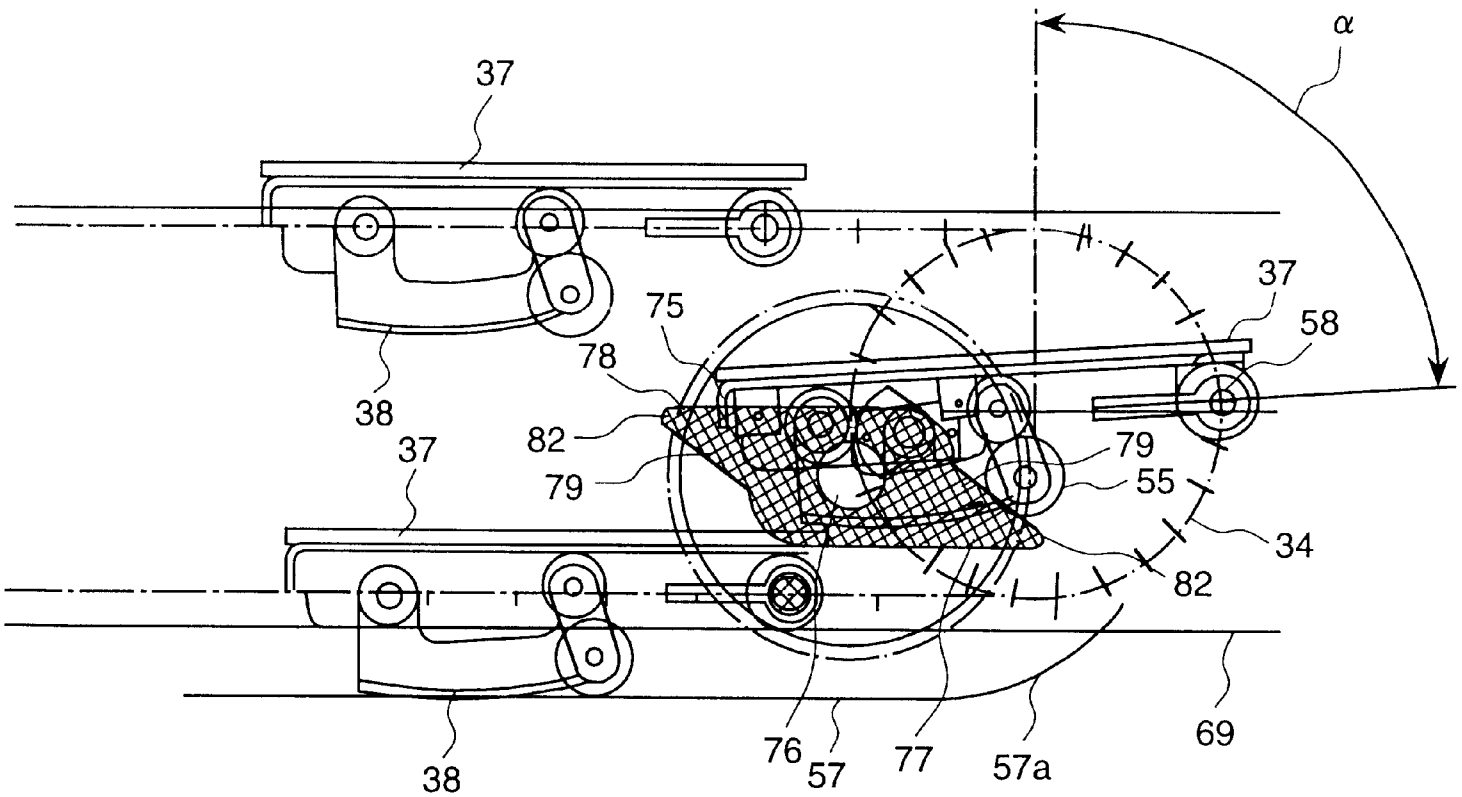
FIG. 17 is a side view indicating a state of the upper sprocket shown in FIG. 8 being rotated by angle $\alpha=86.4°$ from its reference angle.
Figure 18:
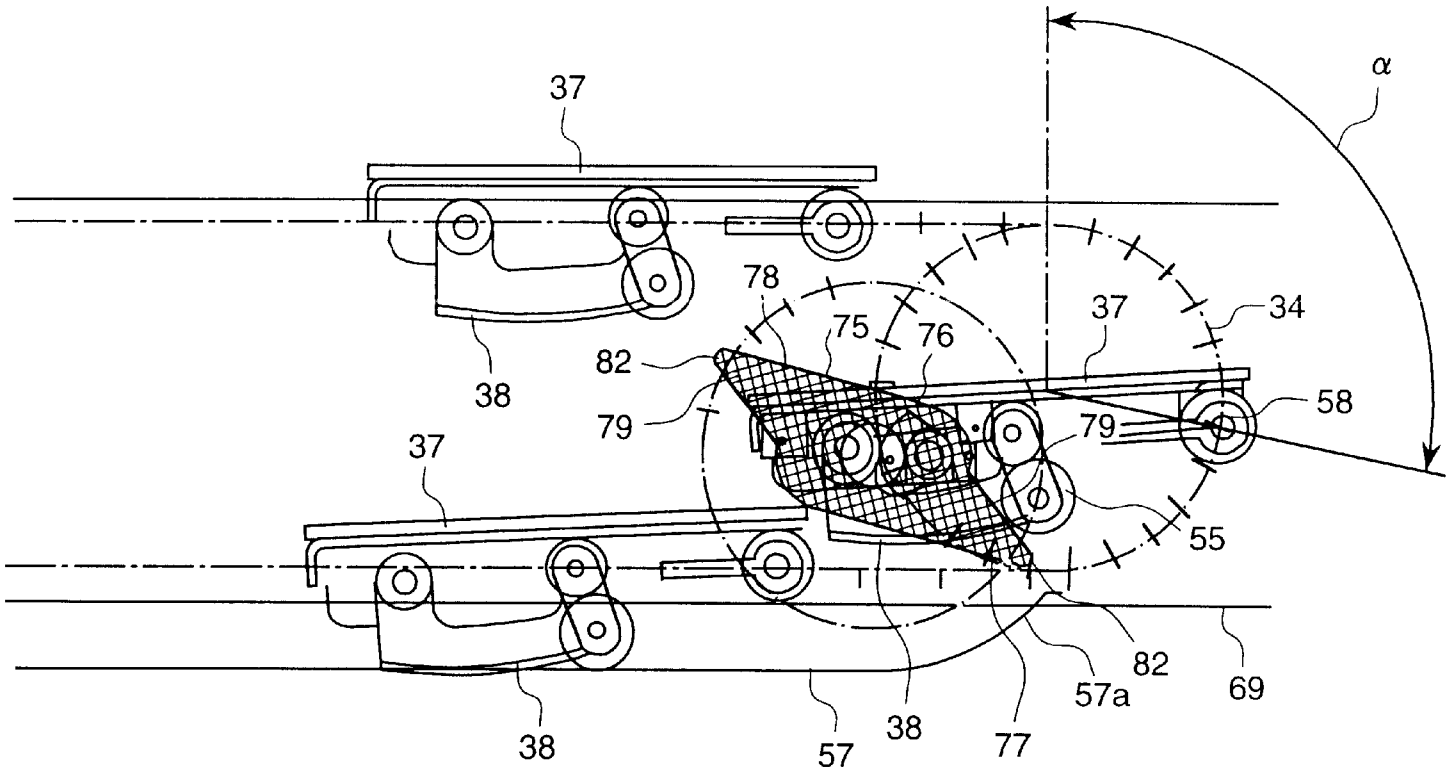
FIG. 18 is a side view indicating a state of the upper sprocket shown in FIG. 8 being rotated by angle $\alpha=100.8°$ from its reference angle.

FIG. 16 shows a state of operation thereof wherein upper sprocket 34 is rotated by angle $\alpha=72°$ from the reference position; FIG. 17 shows a state thereof wherein the same is rotated by angle $\alpha=86.4°$; and FIG. 18 shows a state thereof wherein the same is rotated by $\alpha=100.8°$. In this way, with rotation of upper sprocket 34, riser plate guide means 75 also rotates by the same angle in response thereto, thereby ensuring that the step board 37 will be transferred approximately in a level state while its associated riser plate 38 is retained in the retracted position.

Figure 19:
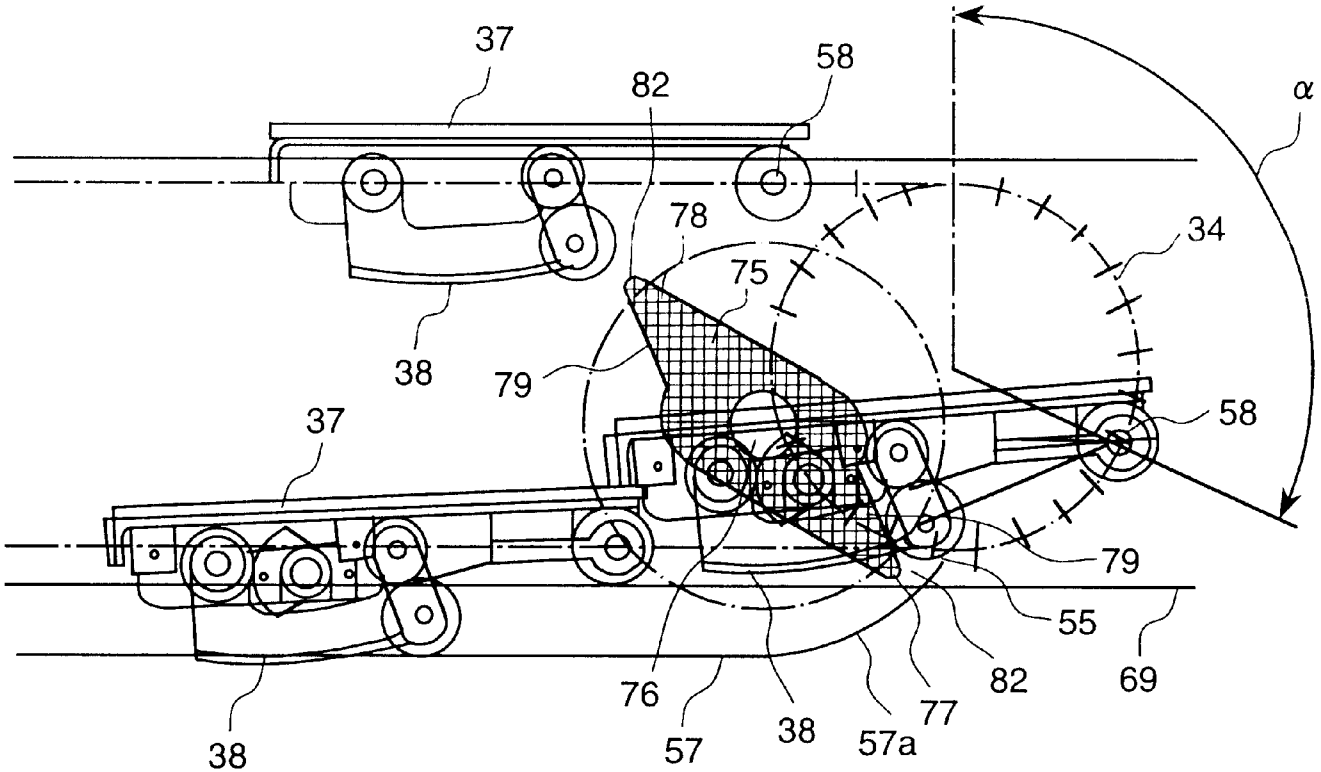
FIG. 19 is a side view indicating a state of the upper sprocket shown in FIG. 8 being rotated by angle $\alpha=115.2°$ from its reference angle.

FIG. 19 depicts a state wherein upper sprocket 34 is rotated by an angle $\alpha=115.2°$. At this instant, guide roller 55 of riser plate 38 is immediately before riding onto the front end portion 57*a* of riser plate lower guide rail 57.

Figure 20:
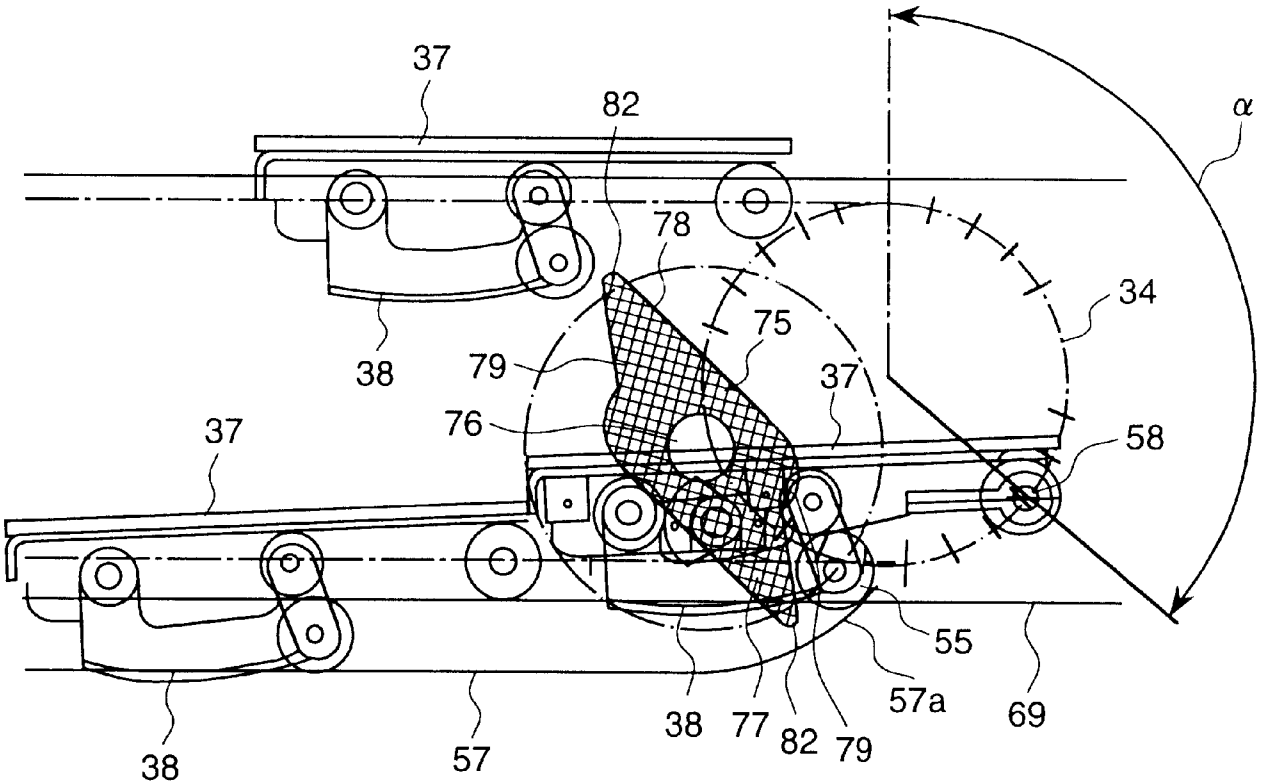
FIG. 20 is a side view indicating a state of the upper sprocket shown in FIG. 8 being rotated by angle $\alpha=129.6°$ from its reference angle.

FIG. 20 depicts a state where in upper sprocket 34 is rotated by angle $\alpha=129.6°$ from the reference position. At this time, guide roller 55 has been transferred completely from receiver 77 of riser plate rotation guide means 75 and is supported by the front end portion 57*a* of riser plate lower guide rail 57 from the bottom.

Figure 21:
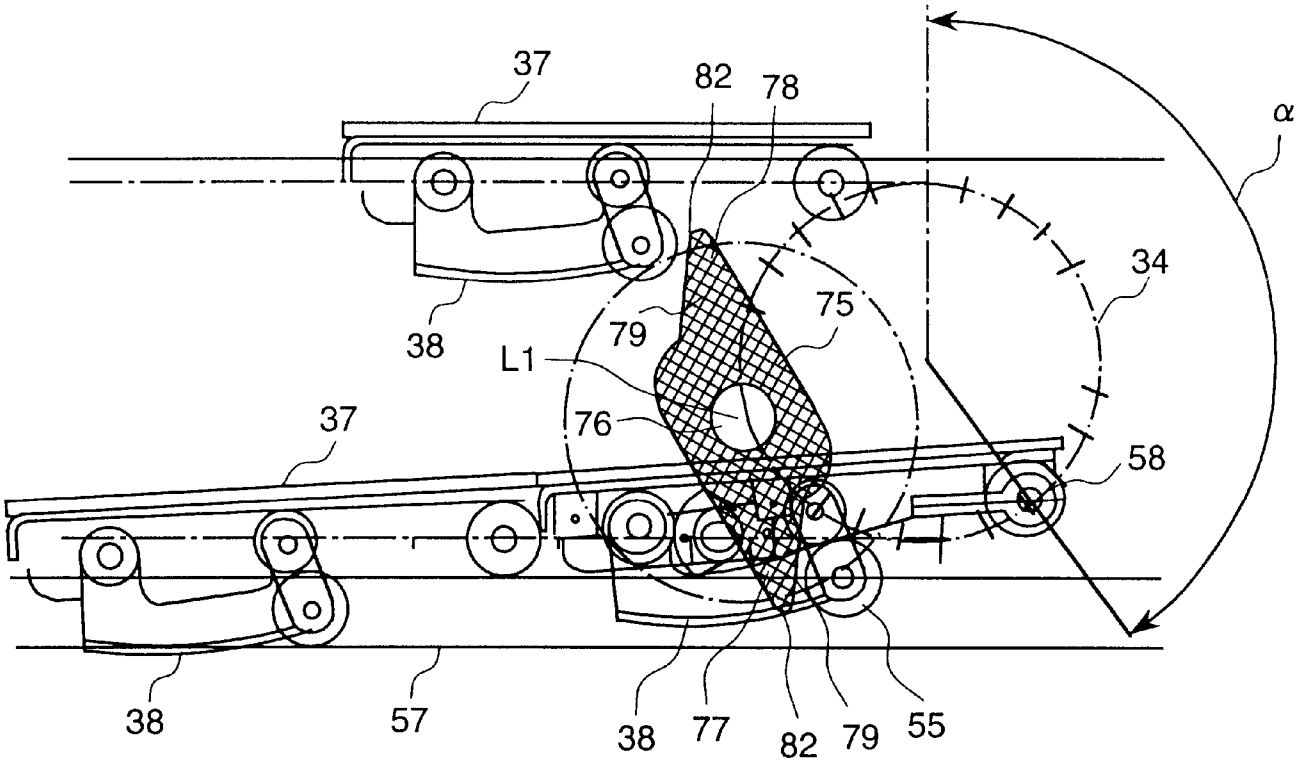
FIG. 21 is a side view indicating a state of the upper sprocket shown in FIG. 8 being rotated by angle $\alpha=144°$ from its reference angle.

FIG. 21 shows a state wherein the upper sprocket 34 is rotated by an angle $\alpha=144°$ from its reference position. At this instant, guide roller 55 is guided along riser plate lower guide rail 57 until a support surface 79 of the other receiver member 78, which is formed symmetrically with respect to rotation axial line L1, is to face a guide roller 55 of another step board 37 subsequent thereto from beneath. When upper sprocket 34 further rotates in this way, receiver member 78 of the other step board is arranged to receive guide roller 55 of the subsequent step board 37 to follow, thereby representing the same state of FIG. 14 described above. In this manner, riser plate rotation guide means 75 is rotated at the same speed as upper sprocket 34, thereby ensuring that each riser plate 38 of subsequent stop boards 37 will be guided sequentially to the lower stretch support frame region S2.

Further, because the front end portion 57*a* of riser plate lower guide rail 57 is formed in a circular arc coaxially around rotation axial line L1 of riser plate rotation guide means 75, the guide roller 55 can be smoothly guided along the circular arc around the rotation axial line L1 by the riser plate rotation guide means 75. By smooth guidance of riser plate 38 as described above, noise generation can be prevented, and step boards 37 can be moved smoothly in a circulation route.

Figure 22:
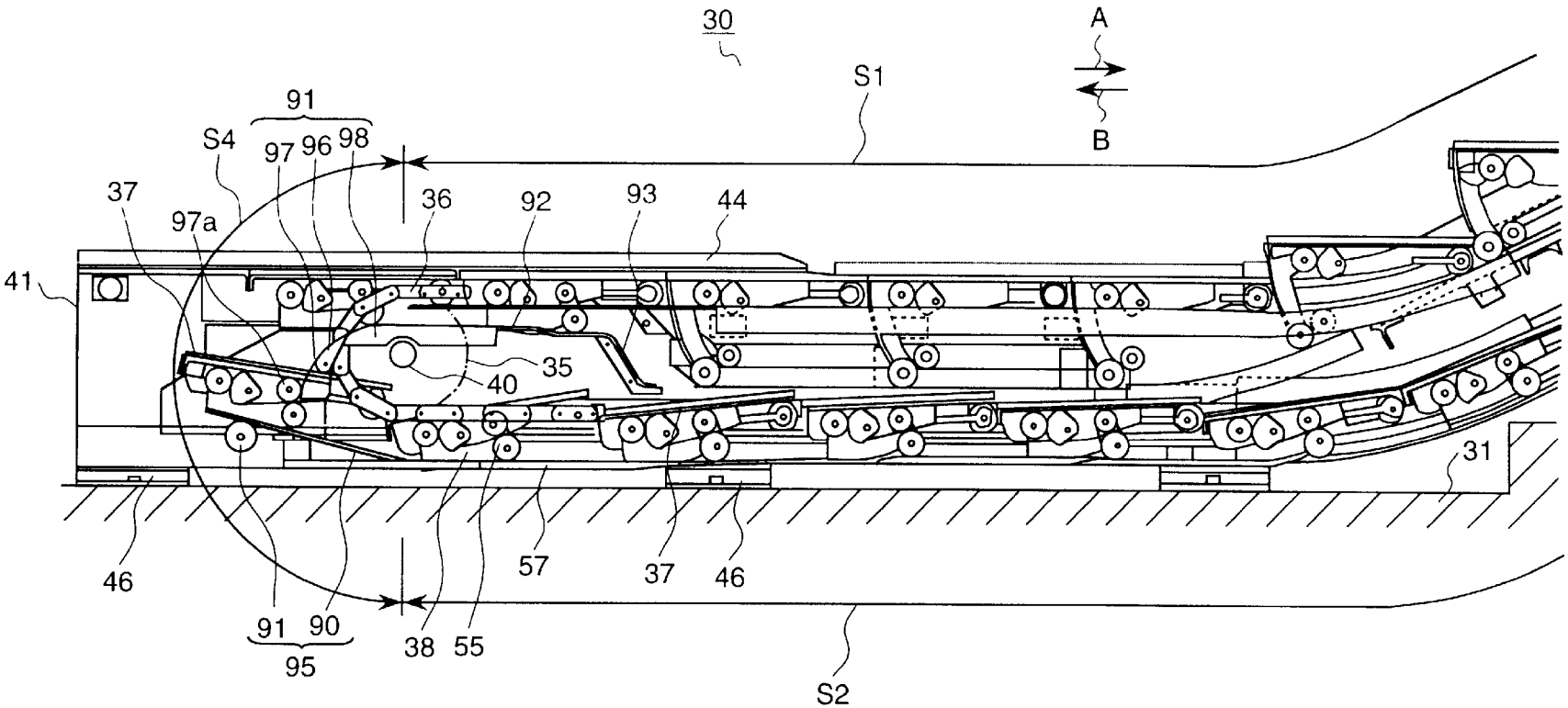
FIG. 22 is a side view indicating a portion in the vicinity of the lower floor in FIG. 8.

With reference to FIG. 22, a side view of the escalator apparatus 30 of the invention in the vicinity of lower floor 31 is indicated with side wall 42 removed. Riser plate lower guide rail 57 is provided with an end portion 90 which is inclined in a lower traveling direction B, which rises upward in the direction B. Beneath this inclined end portion 90 of riser plate lower guide rail 57, there is provided a riser plate guide roller 94. A pair of riser plate guide rollers 94 are spaced from each other in a lateral direction between the inclined end portion 90 of riser plate lower guide rails 57, which are provided separately from each other in a direction of the width. The pair of riser plate guide rollers 94 are mounted so as to be free to rotate around a rotation axial line thereof extending in a lateral direction, and are disposed such that their periphery faces riser plate 38 from beneath which is guided along the inclined end portion 90.

The inclined end portion 90 of riser plate lower guide rails 57 and riser plate guide rollers 94 constitute riser plate guide member 95.

In the upper direction of inclined end portion 90 of riser plate lower guide rails 57, there is provided a first riser plate guide rail 91 whose upward inclination becomes greater downstream in the upward travel direction A. The first riser plate guide rail 91 is provided between the inclined end portion 90 of riser plate lower guide rails 59 and a horizontal guide rail 92 for guiding riser plate 38, 15 which is retained in the retracted position in a horizontal direction in the upper stretch support frame region Sl. The first riser plate guide rail 91 is comprised of: a support piece 97 which is disposed outside of drive chain 36; a connection guide rail 98 which is disposed inside of drive 20 chain 36, and is connected to the horizontal guide rail 92; and an open/close guide member 96 which is supported, so as to be free to change its angle, by the connection guide rail 98 and the support piece 97, and is disposed between the support piece 97 and the connection guide rail 98.

Close/open guide member 96 is provided across a path of the chain, i.e., chain support axis 58 provided on the one end of step board 37. Therefore, in order to avoid interference with the path of the chain support axis 58 when step board 38 moves from lower stretch support frame region S2 to upper stretch support frame region S1, a base end of the close/open guide member 96 is mounted on an upper end of support piece 97 so as to be free to change its angle around an angular displacement axial line extending in a width direction, and a free end portion thereof is anchored on a backward end of connection guide rail 98 (in the left-hand direction in FIG. 22) such that open/close guide member 96 is pushed upward in its open position by the chain support axis to allow for the same to pass between the open/close guide member 96 and connection guide rail 98 when chain support axis 58 of step board 37 traverses, and open/close member 96 is closed after chain support axis 58 has passed therethrough.

Further, because the open/close guide member 96 is made of a synthetic resin, such as acrylic resin, the occurrence of noise can be prevented every time it collides with metallic connection guide rail 98.

Each part of the surfaces facing upward on the support piece 97, open/close guide member 96 and connection guide rail 98 of the first guide rail 91 provide a smooth continuous surface in combination for guiding the guide roller 55 of riser plate 38 up to horizontal guide rail 92. A lower end portion 97a (to the left-hand side in FIG. 23) of the support piece 97 of the first riser guide rail 91 is provided above and in the direction A from riser plate guide roller 94, and the distance b1 from the inclined end portion 90 of riser plate lower guide rail 57 is selected at a value slightly larger than the external diameter D3 of guide roller 55.

Therefore, guide roller 55 is allowed to pass under the first riser plate guide rail 91, to reverse its direction of movement after having passed thereunder, which will be described later, and to ride onto the support piece 97 easily. Further, a front portion 98*a* (to the right-hand side in FIG. 23) of connection guide rail 98 of the first riser plate guide rail 91 provides for a smooth connection to horizontal guide rail 92 which guides step board 37 horizontally while retaining its riser plate 38 in the retracted position for step board 37 when the same is horizontally guided along upper stretch support frame region S1 on the lower floor 31. This front end 98*a* of connection guide rail 98 is disposed above and in the downstream direction A (to the right-hand side in FIG. 23) from the rotation axis 40 of the lower sprocket 35.

As described hereinabove, the first riser plate guide rail 91 and the riser plate guide member 95, which are disposed in a position where the riser plate lower guide rail 57 and the step board upper guide rail 60 are discontinuous, constitute in combination the transfer mechanism for guiding step board 37 therethrough and transferring the same therebetween.

A front end 92*a* of horizontal guide rail 92 (the right hand side thereof in FIG. 23) is connected smoothly to a second riser plate guide rail 93. The second riser plate guide rail 93 is formed to have a slope descending downward in the direction A. As step board 37 moves in the direction A, the guide roller 55 provided at the free end portion of riser plate 38 is guided by this descending slope such that rise plate 38 is disposed smoothly at its closure position immediately before it reaches transport region S5. Further, a small roller guide rail 99 (see FIG. 23) is provided opposite and parallel to the second riser guide rail 93 for guiding small roller 61 provided at the free end portion of riser plate 38 such that the riser plate 38 guided nearly to its retracted position is further ensured to be positioned in the retracted position.

Figure 23:
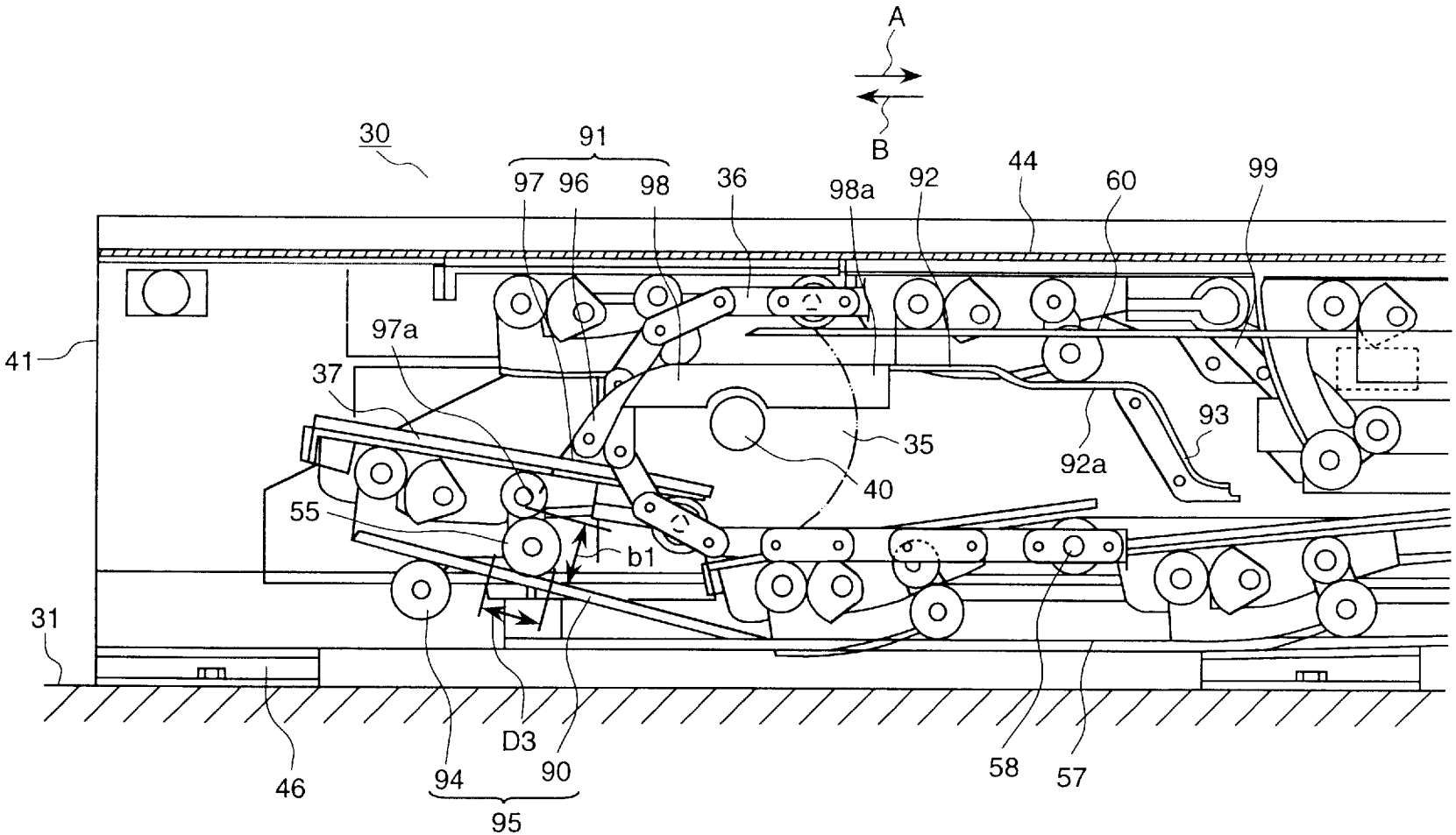
FIG. 23 is a side view of the guide roller depicted in FIG. 8 for indicating a state thereof in which it is guided along a tilt rear end portion of a riser lower guide rail.
Figure 24:
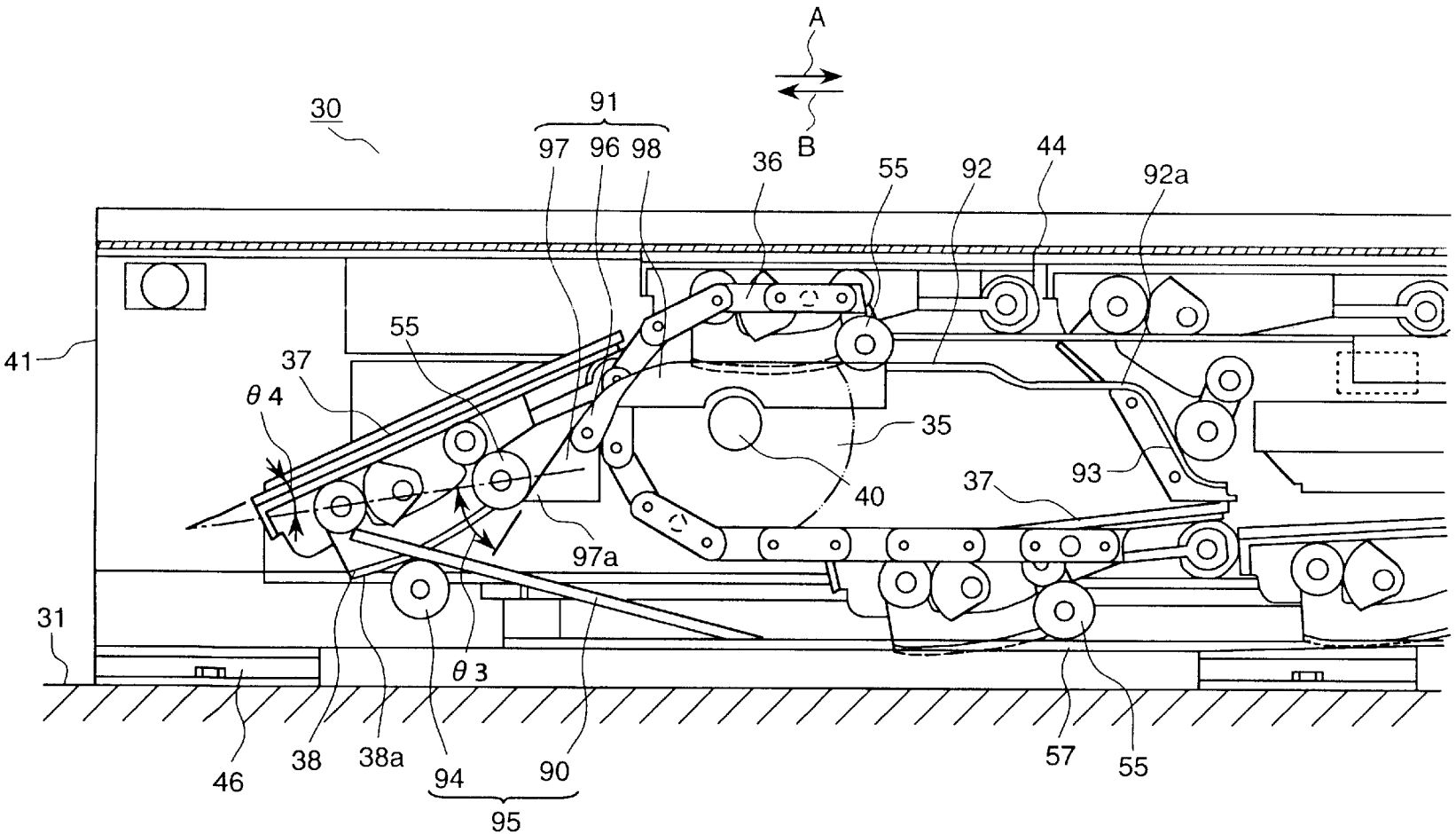
FIG. 24 is a side view of the guide roller depicted in FIG. 8 for indicating a state thereof in which it is moved to ride on a support piece of a first riser guide rail.

With reference to FIGS. 22–24, the motion of riser plate 38 when step board 37 is moving from the lower stretch support frame region S2 to the upper stretch support frame region S1 will be described. When step board 37, which is traveling horizontally in the direction B in lower stretch support frame region S2 on the lower floor 31 arrives in the vicinity of upper transfer region S4, and when step board 37 ascends along the lower sprocket 35, the guide roller 55 on riser plate 38 is guided onto the inclined end portion 90 of riser plate lower guide rail 57 so as to displace riser plate 38 also in the upper direction, thereby allowing for the riser plate 38 to be guided in the upper direction in a state wherein it is retained in the retracted position.

In this manner, when guide roller 55 is guided to the inclined end portion 90 and the lower sprocket 35 is rotated such that step board 37 is guided in the lower travel direction B, the guide roller 55 passes under support piece 97 of the first riser plate guide rail 91, and when the lower sprocket 35 is rotated further, an external surface 38*a* of riser plate 38 makes contact with an external periphery of riser plate guide roller 94 (see FIG. 24) so as to cause the guide roller 55 to move away from the inclined end portion 90 of riser plate lower guide rail 57 in the upper direction.

In this state, when the lower sprocket 35 is further rotated until one end of step board 37 reaches a center portion of upper transfer region S4, the direction of travel of step board 37 is reversed from the downward travel direction B to the upward travel direction A, and, as indicated in FIG. 24, guide roller 55 rides onto support piece 97 of the first riser plate guide rail 91. As step board 37 advances in the upward travel direction A, the guide roller 55 of riser plate 38 is guided on a surface of close/open guide member 96 and connection guide rail 98.

When guide roller 55 just rides over on support piece 97 of the first riser plate guide rail 91, angle θ3 obtained between a line connecting a rotating axial line of guide roller 55 with an axial line of angular displacement axis 64 of step board 37 and a surface of support piece 97 is preferably selected in a range of $0°<\theta3<90°$. Also, angle θ0 formed between the line connecting the angular displacement 25 axis of riser plate 38 with the rotation axial line of guide roller 55 and the surface of step board 37 is preferably selected in a range of $0°<\theta4<90°$.

By selecting angles θ3 and θ4 from this range when the guide roller 55 makes contact with the support piece 97 of the first riser plate guide rail 91, it is ensured for riser plate 38 to be guided along support piece 97 of the first riser plate guide rail 91 in the upper direction in a state wherein it is retained in the retracted position when the one end of step board 37 moves from the center portion of the upper transfer region S4 toward the upper stretch support frame region S1 with the guide roller 55 landing on support piece 97.

Because the guide roller 55 is guided along the first riser plate guide rail 91 above the rotational axis 40 of the lower sprocket 35 and up to the downstream end of the upward travel direction A with the riser plate 38 being retained in the retracted position, the possibility that the riser plate 38 will interfere with the rotational axis 40 of the lower sprocket 35 can be avoided, thereby ensuring that the step board 37 will move smoothly.

When step board 37 further advances in the upward travel direction A in the upper stretch support frame region S1, the guide roller 55 is guided along horizontal guide rail 92, and when guide roller 55 arrives at the second riser plate guide rail 93, guide roller 55 makes contact with the second riser plate guide rail 93 in the bottom direction, then smaller roller 61 makes contact with small roller guide rail 99, and with advancement of step board 37 in the upper travel direction A, the guide roller 55 is guided such that its riser plate 38 is smoothly placed in the retracted position thereof.

By this smooth guidance according to the invention, a problem is prevented wherein riser plate 38 is rapidly released from the retracted position to the closure position thereby allowing for the upper end portion 62 of the riser plate to collide with anchor end portion 63 of step board 38, and thereby preventing each step board 37 from moving smoothly due to impact of this collision. As described above, riser plate 38 is ensured to be positioned in the closure position immediately before entering the transport region S5 by action of the second riser plate guide rail 93.

In this embodiment of the invention as described heretofore, reference is made by way of example to an upward destined escalator wherein each step board 37 is traveling in the upward direction in the upper stretch support frame region S1 from the lower floor 31 to the upper floor 32, however, the invention is not limited thereto, and the same advantages and features according to the invention can be accomplished when applied to a downward destined escalator as well.

Figure 25:
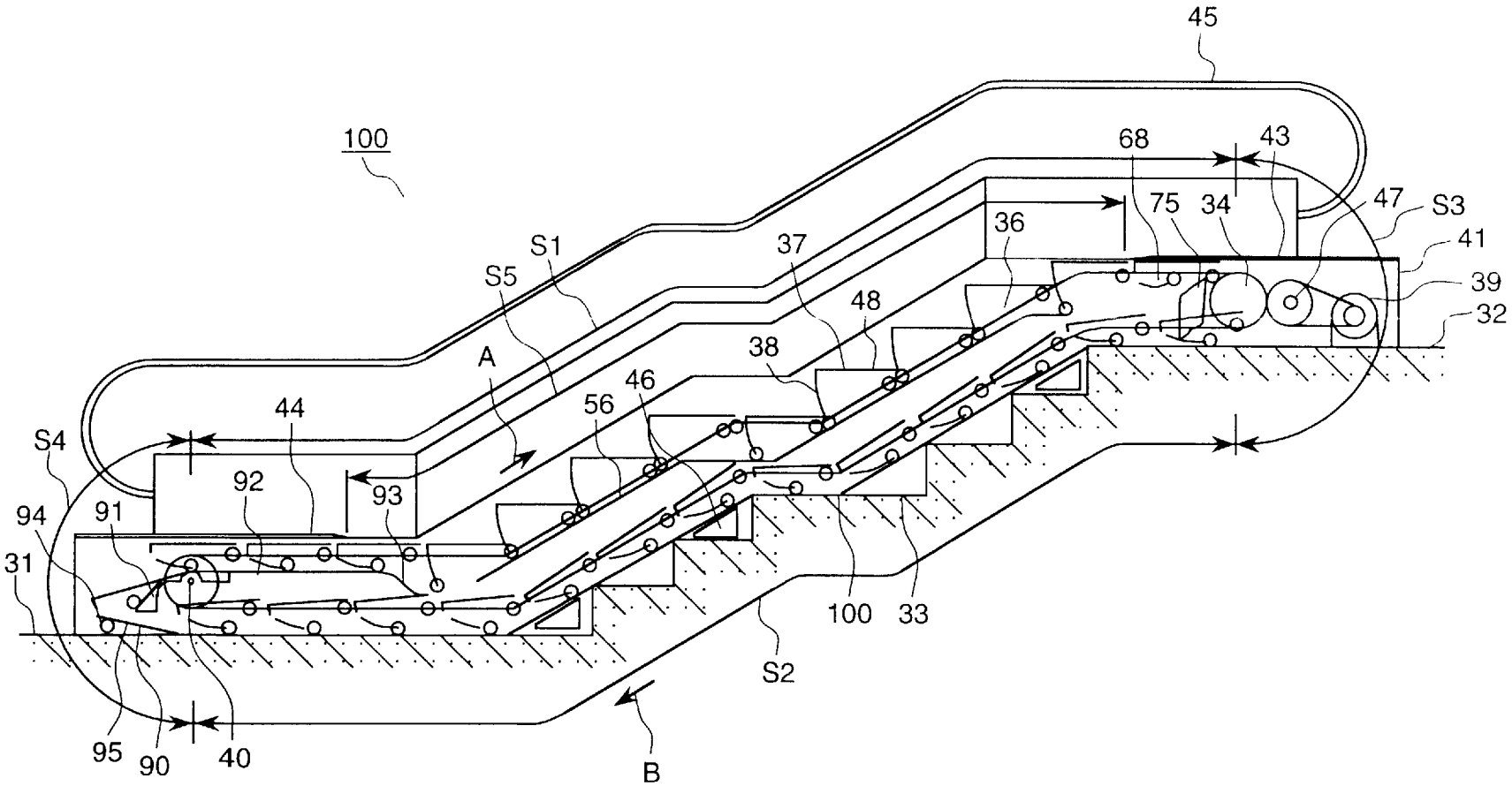
FIG. 25 is a side view of an escalator apparatus according to a fourth embodiment of the invention.

FIG. 25 is a side view of an escalator apparatus 100 according to a fourth embodiment of the invention. The same components and parts as in FIGS. 1–24 are labeled with the same reference numbers.

A stair case 33 on which escalator apparatus 100 is installed has a platform 101 which is on a level disposed between lower floor 31 and upper floor 32. A drive chain 36 is stretched along the staircase 33 having such platform 101, and support frame 41 is also installed along this staircase 33. Namely, escalator apparatus 100 has a level portion in the platform 33.

Even in this escalator apparatus 100 of the invention, step board 37 can be arranged to travel circularly between the upper and the lower floors along drive chain 36 for transporting passengers from the lower floor up to the upper floor.

Figure 26:
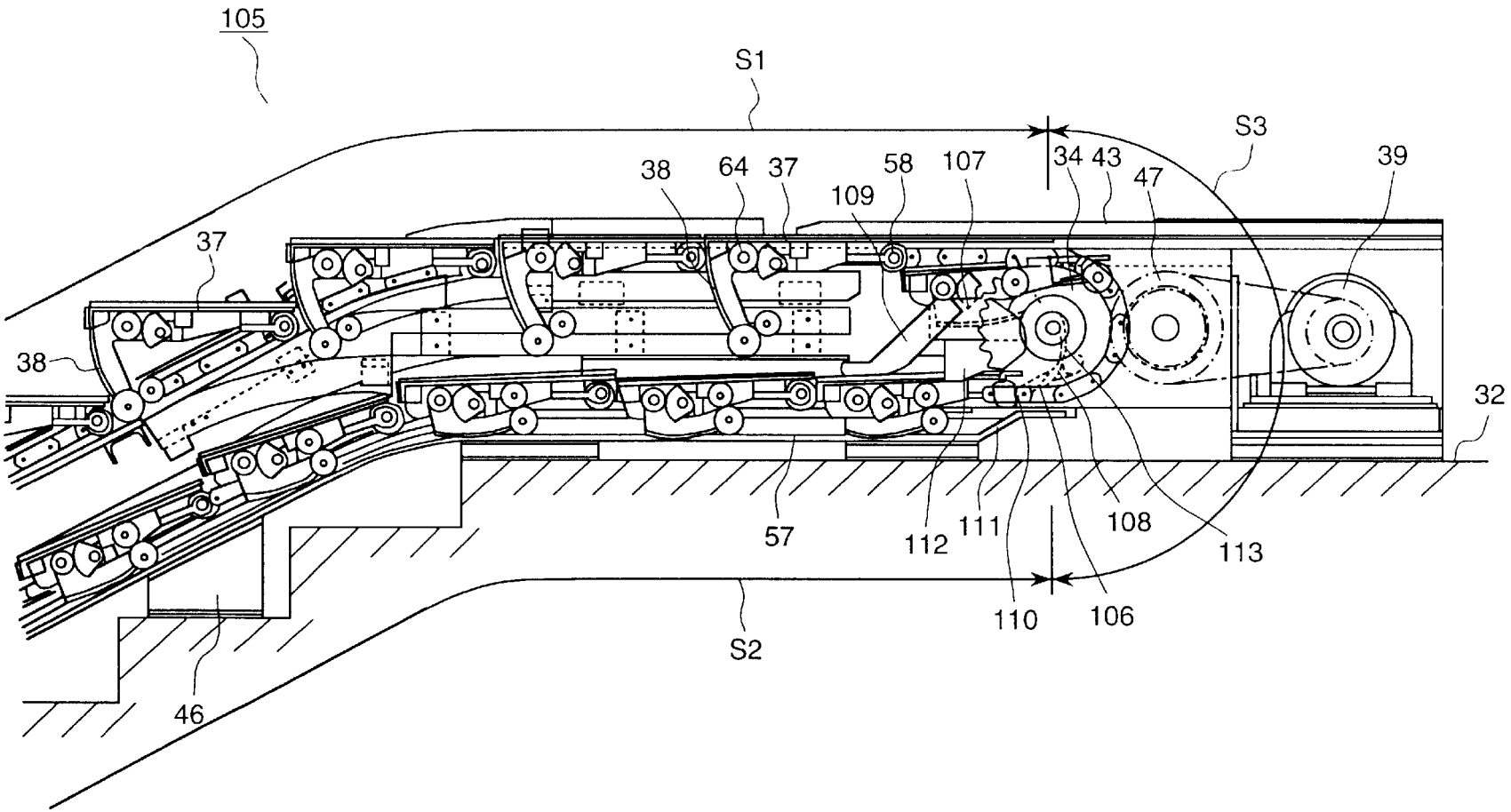
FIG. 26 is a side view in part in the vicinity of an upper floor of an escalator apparatus according to a fifth embodiment of the invention.

FIG. 26 is a side view of an escalator apparatus 105 according to a fifth embodiment of the invention, showing a portion in the vicinity of the upper floor 32. The same components and parts as in FIGS. 8–24 are labeled with the same reference numbers.

In escalator apparatus 105, a riser plate guide means 106 is provided in the vicinity of upper sprocket 34 on the upper floor 32 for guiding a guide roller 55 provided on a free end portion of riser plate 38 associated with a step board 37 when step board 37 is moving from upper path support frame region S1 to lower path support frame region S2 in lower transfer region S3 while retaining riser plate 38 positioned in its retracted position.

Figure 27:
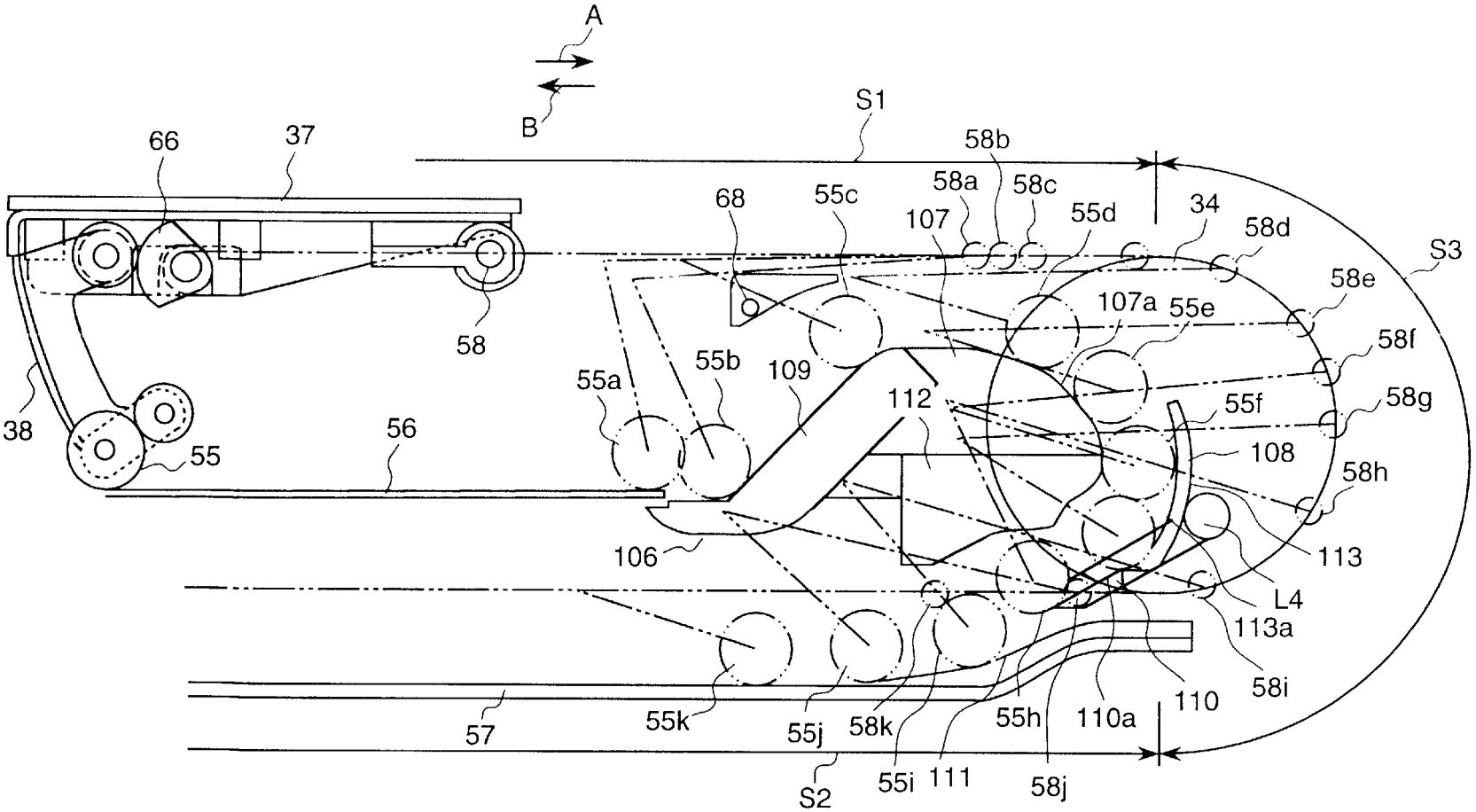
FIG. 27 is an enlarged side view in the vicinity of an upper sprocket of FIG. 26.

FIG. 27 is an enlarged side view in part of the escalator in the vicinity of riser plate guide means 106. By the way, a path of motion of chain support axis 58 of step board 37 in FIG. 27 is indicated sequentially in periods of time elapsed by virtual lines 58*a*–58*k* of the chain support axis 58, and a path of motion of guide roller 55 corresponding thereto is indicated sequentially by virtual lines 55*a*–55*k* likewise.

A riser plate retraction guide member 109 is provided on the side of a front end portion of riser plate upper guide rail 56 in the upper path support frame region SI, which is inclined in the upper direction downstream of the upward travel direction A for guiding guide roller 55 of step board 38 as retained in the retracted position. When traveling in the upward travel direction A in the upper path support frame region S1, the riser plate 38 is caused to be positioned in its retracted position immediately before arriving at lower transfer region S3 by guide roller 68. At this time, retraction guide member 109 auxiliary guides the guide roller 55, and prevents riser plate 38 from displacing its angle toward the closure position when guide cam 66 of step board 37 leaves guide roller 68.

Riser plate guide means 106 is comprised of upper guide member 107 and lower guide member 108, wherein the upper guide member 107 is disposed inside of a path of transfer of guide roller 55 of riser 38, and has an upper guide surface 107*a* which makes contact with the guide roller 55 and supports the same from the bottom, such that the riser plate is retained in the retracted position and the step board 37 is guided in a state in which it is approximately level when chain support axis 58 provided at one end of riser 37 is moved from the upper end to the center portion in lower transfer region S3.

Lower guide member 108 is disposed outside of the path of transfer of guide roller 55 of the riser plate. When chain support axis 58 provided on one portion of step board 37 is moved from the center portion in the lower transfer region to lower stretch support frame region S2, the lower guide member 108 makes contact with the guide roller 55 of riser 38 from the bottom such that riser plate 38 is ensured to be positioned in the retracted position and step board 37 is guided in a state in which it is approximately level.

This lower guide member 108 is comprised of a circular arc guide rail 113; and a lower end guide member 110 which is inclined from a lower end of guide rail 113 toward riser plate lower guide rail 57 and is mounted so as to be free to rotate around an angular displacement axial line extending in a width direction in a back side of the guide rail 113 (on the right-hand side in FIG. 27), wherein the internal periphery 113*a* of guide rail 113 facing upward and a surface 110*a* of lower end guide member 110 facing upward constitute a lower guide surface of the lower guide member 108. Further, in order to prevent the guide roller 55, which is guided along the lower guide member 108, from being displaced in the upper direction, upper displacement prevention member 112 is provided opposite to the lower guide member 108.

Further, a front end portion 111 (on the right-hand side in FIG. 27) of riser plate lower guide rail 57 for guiding guide roller 55 of riser 38 in the lower stretch support frame region S2 is formed to have an upper inclination toward the lower end guide member 110.

Now, the motion of riser plate 38 in the lower transfer region S.3 when step board 37 descends to the lower floor will be described.

When upper sprocket 34 is rotated and step board 37 moves horizontally in the upward travel direction A on the upper floor 32, riser plate 38 is retracted by guide roller 68 immediately before chain support axis 58 arrives at the lower transfer region S3. The position of guide roller 55 at this instant is indicated virtually by guide roller 55*c* in FIG. 27.

When upper sprocket 34 is further rotated from the state described above, and chain support axis 58 of step board 37 is guided along lower transfer region S3 in a circular arc to the center portion of lower transfer region S3, the guide roller 55 is guided along the circular arc guide surface 107*a* of upper guide member 107 such that step board 37 is transferred in a state where it is approximately level with its associated riser plate 38 retained in the retracted position. When the upper sprocket 34 is rotated still further, the guide roller 55 is transferred from the upper guide member 107 to guide rail 113 of lower guide member 108. The position of guide roller 55 at this instant is indicated by guide roller 55*f* depicted in virtual line.

As the chain support axis 58 moves downward from the center portion of lower transfer region S3 toward lower stretch support frame regions S2 as described above, the guide roller 55 is guided along the circular arc guide rail 113. During this period, step board 37 is guided approximately in a state in which it is level with its associated riser plate 38 being retained in the retracted position.

When guide roller 55 is guided to the lower end portion of guide rail 113, the same passes over to lower end guide member 110 of lower guide member 108, and further passes over from this lower, end guide member 110 to front end portion 111 of riser plate lower guide rail 57.

Because the lower end guide member 110 is provided so as to be capable of angular displacement as described previously, the same is allowed to adjust its angle such that the guide roller 55 is smoothly guided from the bottom end of guide rail 113 toward the front end portion ill of riser plate lower guide rail 57.

As described hereinabove, because the riser plate is ensured to be guided smoothly while being in the retracted position by the riser plate guide means 106 during its transition from the upper stretch support frame region S1 to the lower stretch support frame region S2, the problem associated with the prior art that the prior art guide roller suspended from a prior art riser plate collides severely with a lower stretch support frame region S2 when descending so as to generate a noise and/or prevent a smooth travel of each step board can be solved according to the invention.

Respective embodiments of the invention described herein above have been made by way of example of respective escalator apparatuses that can be installed on existing staircases, however, the invention is not limited thereto, and the present invention can be applied to a new escalator apparatus that is to be installed, for example, along any slope in a house, building, or in the field.

Furthermore, still another embodiment of the invention, which is not limited to an escalator system, can be contemplated as a sixth embodiment of the invention such as, for example, an auto lane 200 indicated in FIG. 28.

This auto lane 200 is installed on a level plane floor, and has such a structure that a part of its support frame 201 is buried under the floor, a pair of drive side sprockets 203 supported by each independent axis to be driven by a transport drive source 202 are provided rotatably on both sides of one end portion in the longitudinal direction of support frame 201, while on both sides of the other end portion thereof, a pair of follower sprockets 204 are supported rotatably around a common axis.

A pair of endless drive chains 205 are wound around these pairs of sprockets 203 and 204, and are stretched therebetween. Then, a plurality of step boards 206 are coupled between the pair of endless drive chains. An upper guide rail 207 is installed so as to extend between these two pairs of sprockets 203 and 204 on the side of the forward path so as to guide step boards 206 in a level state. Further, on the side of return path of step boards 206, a lower guide rail 208 is installed between these two pairs of sprockets 203 and 204 such that step boards 206 do not interfere with the bottom portion of support frame 201.

Further, also in this kind of auto lane 200, in the vicinities of the above-mentioned two pairs of sprockets 203 and 204, a guide means, as described above, that can reverse the direction of travel with an upper surface of step board 206 maintained facing upward, can be provided.

Therefore, it is not necessary to provide for a large diameter sprocket so as to be able to rotate step board 206 upside down through 180°, thereby reducing the height of support frame structure 201, and thereby minimizing the construction work required to dig the floor necessary for installing an auto lane which is partly buried under the floor.

As described heretofore, the escalator apparatus according to the invention has been provided in which the height dimension of the machine room for accommodating the support frame structure 201 can be reduced so as to be able to minimize the space for installation thereof, and in which the reversal of directions of movement of each step board can be performed smoothly without interference.

What is claimed is:

1. A passenger transportation conveyor apparatus having a plurality of step boards connected endlessly so as to travel circularly in a support frame provided between a lower floor and an upper floor, wherein each of said plurality of step boards is mounted to travel circularly in forward and return routes with a surface of each step board maintained facing upward.

2. A passenger transportation conveyor apparatus having a plurality of step boards connected endlessly so as to travel circularly in a support frame provided between a lower floor and an upper floor, wherein each of said plurality of step boards is mounted to travel circularly in forward and return routes with a surface of each step board maintained facing upward, and wherein a guide rail is provided in an intermediate portion on said forward route for guiding each of said plurality of step boards as maintained horizontally.

3. A passenger transportation conveyor apparatus having a plurality of step boards connected endlessly so as to travel circularly in a support frame provided between a lower floor and an upper floor, wherein said support frame structure is provided with a guide rail for guiding each of said plurality of step boards to travel circularly on both sides of forward and return routes respectively, and a discontinuity of said guide rail is provided in the vicinity of a position at which said travel routes change from the forward to return paths or vice versa, and further a transfer mechanism is provided in a space of this discontinuity of said guide rail for transferring each of said plurality of step boards with a surface of each step board being maintained facing upward between said forward and return routes or vice versa.

4. A passenger transportation conveyor apparatus having a plurality of step boards connected endlessly so as to travel circularly in a support frame provided between a lower floor and an upper floor, wherein a guide means is provided between an end of a forward route and an end of a return route for reversing a direction of movement of each of said plurality of step boards with a surface of each step board maintained facing upward.

5. A passenger transportation conveyor apparatus having:

a pair of upper sprockets and a pair of lower sprockets supported rotatably on an upper floor and a lower floor respectively, within a support frame structure extending between the lower floor and upper floor; a pair of endless drive chains wound around these pairs of sprockets and stretched therebetween; and a pair of step boards connected between this pair of drive chains for traveling circularly in a forward route and a return route formed along a longitudinal direction of said support frame structure, wherein each one of said plurality of step boards is arranged to pass between said pair of sprockets at least on one side of a set of said upper and lower sprockets, and to pass along an external periphery of said pair of sprockets on the other side of the set of said upper and lower sprockets.

6. A passenger transportation conveyor apparatus having:

a pair of upper sprockets and a pair of lower sprockets supported rotatably on an upper floor and a lower floor, respectively, within a support frame structure extending between the lower floor and upper floor; a pair of endless drive chains wound around these pairs of sprockets and stretched therebetween; and a pair of step boards, each having a riser plate associated therewith, connected between this pair of drive chains for traveling circularly in a forward route and a return route formed along a longitudinal direction of said support frame structure, wherein each one of said plurality of step boards is ensured to travel circularly on the forward and return routes with its surface maintained facing upward, and wherein said each step board is connected to said drive chain at its end portion opposite to its connection to said riser plate, further wherein each step board is guided as maintained in level while guiding said riser plate associated therewith in a closed position on the forward route.

7. A passenger transportation conveyor apparatus having a plurality of step boards connected endlessly for traveling circularly in a support frame structure provided between upper and lower floors, wherein said plurality of step boards are arranged to travel circularly both in forward and return routes with a surface of each one of said plurality of step boards maintained in a state facing upward, and wherein a riser plate folding means for retracting the same into a retracted position in its return route is provided.

8. A passenger transportation conveyor apparatus having a plurality of step boards connected endlessly for traveling circularly in a support frame structure provided between upper and lower floors, wherein means is provided for folding a riser plate associated with each one of said plurality of step boards into a retracted position on a bottom of said step board in the vicinity of an end point of a forward route and for releasing the riser plate to its initial position in the vicinity of a start point of the forward route.

9. A passenger transportation conveyor apparatus having a plurality of step boards connected endlessly for traveling circularly in a support frame structure provided between upper and lower floors, wherein riser plate folding means for retracting a riser plate is provided in the vicinity of an end portion of a forward route for said plurality of step boards, and wherein a transport means is provided on a return route for said step boards for transporting said plurality of step boards in a state with its surface maintained facing upward and with said riser plate associated therewith retained in the retracted position.

10. A passenger transportation conveyor apparatus according to claim 7, wherein said riser plate folding means is provided at a position immediately before a start of reversal of direction of movement of a step board.

11. A passenger transportation conveyor apparatus comprising: an upper sprocket provided in an upper position; a lower sprocket provided in a lower position; an endless drive chain wound around said upper and lower sprockets and stretched therebetween; a drive source for driving said drive chain in a predetermined direction; a plurality of step boards each of which is connected with said drive chain at one end portion thereof so as to travel circularly in forward and return routes thereof in a state having a surface of each step board for transporting a passenger thereon retained facing upward; a plurality of riser plates each of which is associated with each one of said plurality of step boards, a base portion of which is connected, capable of angular displacement, with the other end portion of each step board such that the riser plate is ensured to be positioned in a closure position suspended in a bottom direction so as to close a gap between respective adjoining step boards when traveling in the forward direction, while in the return direction, the riser plate is folded into a retracted position because a free end portion thereof opposite to the base end is displaced angularly to approach the step board to become approximately parallel thereto immediately before the step board reaches a lower transfer region between the forward and return routes;

and a riser plate guide means for guiding the step board in a lower transfer region with the riser plate retained in the retracted position.

12. A passenger transportation conveyor apparatus according to claim 9 wherein said riser plate guide means comprises: an axial line of rotation internal of the drive chain and parallel with an axial line of rotation of one of the upper and the lower sprockets; and a receiver portion formed thereon projecting into a path of movement of the free end portion of the riser plate when the step board descends along the lower transfer region with the riser plate retained in the retracted position, for supporting and guiding the play end portion of the riser plate in the transition of the step board in a lower direction of the lower transfer region.

13. A passenger transportation conveyor apparatus according to any one of claims 11 and 12, wherein said riser plate guide means comprises: an upper guide member which is disposed internal of a path of movement of the free end portion of the riser plate, and has an upper guide surface for supporting the free end portion of the riser plate by making contact therewith from the bottom when the one end of the step board descends from an upper path support frame region to the center portion of the lower transfer region; and a lower guide member having a lower guide surface which is disposed external of a path of movement of the free end portion of the riser plate for supporting the free end portion thereof by making contact therewith from the bottom thereof when the step board moves from the center portion of the lower transfer region to a lower path support frame region.

14. A passenger transportation conveyor apparatus according to any one of claims 11 and 12, further comprising:

a riser plate guiding piece which is disposed in the vicinity of another sprocket for transferring a step board from a lower path support region to an upper path support region for guiding the riser plate by making contact therewith from the bottom when one end portion of the step board is moved from the lower path support region to a center portion of the upper transfer region where the drive chain is wound around the other sprocket; a first riser plate guide rail which is provided in the upper direction of an axial line of rotation of the other sprocket and horizontally for guiding the free end portion of the riser plate by making contact therewith from the bottom thereof when the step board is transferred from the center portion of the upper transfer region toward a downstream in the upper path support region; and a second riser plate guide rail for guiding the free end portion of the riser plate guided thereto by the first riser guide rail in a lower direction by making contact therewith from the bottom such that the riser plate is positioned in the closed position immediately before the step board reaches the conveyor region.

15. A passenger transportation conveyor apparatus according to any one of claims 11–12 wherein said drive chain is stretched along a staircase having a level platform in an intermediate section between an upper and lower floors.

16. A passenger transportation conveyor apparatus comprising a plurality of step boards connected endlessly to travel circularly in forward and return routes in a support frame which is installed on a staircase connecting upper and lower floors, wherein each one of said plurality of step boards is allowed to reverse its direction of travel from the forward to the return routes or vice versa with the riser plate associated with each step board folded in 9 retracted position.

17. A passenger transportation conveyor apparatus according to claim 16, wherein each step board is ensured to travel circularly in the forward and the return routes with its upper surface always retained facing upward.

* * * * *